US012669134B2

(12) United States Patent
Lin et al.

(10) Patent No.: US 12,669,134 B2
(45) Date of Patent: Jun. 30, 2026

(54) FAN ANTI-FOREIGN MATTER STRUCTURE

(71) Applicant: Global WIN Technology Co., Ltd., Taipei (TW)

(72) Inventors: Shih-Jen Lin, Taipei (TW); Ching-Yao Chen, Taipei (TW)

(73) Assignee: GLOBAL WIN TECHNOLOGY CO., LTD., Taipei City (TW)

( * ) Notice: Subject to any disclaimer, the term of this patent is extended or adjusted under 35 U.S.C. 154(b) by 0 days.

(21) Appl. No.: 18/829,442

(22) Filed: Sep. 10, 2024

(65) Prior Publication Data

US 2025/0215901 A1 Jul. 3, 2025

(30) Foreign Application Priority Data

Jan. 2, 2024 (TW) ..... 113100124

(51) Int. Cl.
*F04D 29/70* (2006.01)
*F04D 19/00* (2006.01)
*F04D 29/32* (2006.01)

(52) U.S. Cl.
CPC ..... *F04D 29/703* (2013.01); *F04D 19/002* (2013.01); *F04D 29/325* (2013.01)

(58) Field of Classification Search
CPC .... F04D 29/703; F04D 19/002; F04D 29/325; F04D 29/289; F04D 29/70
See application file for complete search history.

(56) References Cited

U.S. PATENT DOCUMENTS

2006/0284503 A1* 12/2006 Lin ..... H02K 5/163 310/90
2011/0073280 A1* 3/2011 Liu ..... F04D 25/062 165/95
2014/0064973 A1* 3/2014 Ren ..... F04D 29/388 29/889.6
2019/0093669 A1* 3/2019 Inouchi ..... F04D 19/002
2020/0373804 A1* 11/2020 Chou ..... F04D 25/0693
2022/0128090 A1* 4/2022 Jang ..... F04D 29/063
2025/0084861 A1* 3/2025 Lin ..... F04D 25/062
2025/0084865 A1* 3/2025 Yu ..... F24F 1/38

* cited by examiner

*Primary Examiner* — Aaron R Eastman
(74) *Attorney, Agent, or Firm* — MUNCY, GEISSLER, OLDS & LOWE, P.C.

(57) ABSTRACT

A fan anti-foreign matter structure includes a fan frame, and a fan wheel mounted in the fan frame to leave only the gap between the fan hub and a fan frame axle seat disk or a circuit board on a fan hub and the axle seat disk (i.e. fan hub interior space air outlet). The fan wheel is equipped with an air diversion radiator plate surrounding a rotating shaft, so that air ducts are defined between airflow guide ribs and airflow guide ring of the air diversion radiator plate. Each air duct has an air inlet slot one side, and an airflow turning curved surface on the other side for squeezing airflow entering the air duct outward to discharge hot air downward so that a positive pressure is formed at an air outlet to prevent dirty air containing dust, salt, etc. from the external space from entering a fan hub.

5 Claims, 14 Drawing Sheets

FAN ANTI-FOREIGN MATTER STRUCTURE

This application claims the priority benefit of Taiwan patent application number 113100124, filed on Jan. 2, 2024.

BACKGROUND OF THE INVENTION

1. Field of the Invention

The present invention provides a fan structure technology, especially a fan anti-foreign matter structure is capable of discharging foreign matter inside the fan wheel to the outside, which has the drive unit installed between the fan frame and the fan wheel, and an encapsulation layer is formed on the circuit board of the drive unit and the silicon steel sheet wound stator. Through the rotation of a plurality of air diversion radiator plates at the bottom of the interior space of the fan wheel, the air in the fan hub is circulated in the interior space and discharged outward, thereby preventing dirty air containing dust, salt, etc. from the external space from entering the interior space to maintain the operation of the fan wheel and extend the service life of the fan.

2. Description of the Related Art

Today's computers have powerful computing capabilities and their speed is rapidly increasing to enhance the execution performance of the computers. Since various electronic components such as the central processing unit (CPU), image processor, power supply or various interface cards inside the computer host have ultra-high-speed computing functions, various electronic components will generate relatively large amounts of heat energy when processing computing instructions, which also causes the temperature inside the computer host to rise. The heat dissipation devices, fans, etc. assist various electronic components to dissipate heat. The fan usually has a fan frame, a fan wheel, a circuit board, and the rotor and stator of the drive motor. During the operation of the fan, the motor installed between the fan wheel and the fan frame rotates and drives the fan wheel to rotate to blow or extract air. When the motor drives the fan wheel to rotate, the high-speed rotation of the fan wheel can easily guide the water vapor evaporated by external thermal energy into the interior of the fan wheel, which can easily bring foreign matter (such as water vapor, salt spray or dust, etc.) around the fan or various electronic components into the interior. The long-term accumulation of foreign matter inside the fan wheel and fan frame can easily affect the abnormal operation of the fan wheel, causing the fan to easily malfunction and shorten its service life.

However, the functions currently applied to servers require increasingly large amounts of data to be stored, transmitted, and calculated. Therefore, due to the improvement in computing capabilities of the central processing unit (CPU) used in the server, the heat energy generated also increases, and the relative temperature difference, thermal conductivity and wattage also increase at the same time. The fan used to dissipate heat for the central processing unit (CPU) of the server must dissipate the increased wattage of the server through the fan. Because under the existing fan height size (1 U or 2 U) specification, the heat dissipation performance of the fan can only be increased by increasing the fan rotational speed, and the wattage of the fan motor needs to be increased to cope with the increase in fan rotational speed. However, when the wattage of the motor is increased, the enameled wires of the motor will be easily burned out due to high temperature, which poses a high risk. In order to prevent the fan from bringing in external water vapor or salt spray when rotating at high speed, which will affect the rotor (magnet), stator (silicon steel sheets and enameled wire winding sets) and circuit board of the drive motor to cause rusting and oxidation to further affect the operation of the drive motor. To prevent external water vapor or salt spray from invading the drive motor, the method of coating or sealing is usually performed on the outside of the stator and the circuit board. Although it can avoid drive motor failure and damage, etc., when the fan wheel of the fan rotates, it is easy to bring foreign matter (such as water vapor, salt spray or dust, etc.) around the fan or various electronic components into the interior. Not only it is easy to affect the normal operation of the drive motor, but foreign matter is still easy to accumulate in the air gap between the magnet and the silicon steel sheets. After long-term accumulation, it will also affect the smooth operation of the fan wheel, which is more likely to cause the fan to malfunction and shorten the service life of the fan. It really needs to be improved.

Therefore, how to solve the problems and troubles that the current fans, which are used as heat dissipation devices to assist various electronic components in dissipating heat, are affected by the foreign matter brought in by the external airflow to shorten its service life, and the problems and troubles that that foreign matter accumulated inside the fan is difficult to remove, and the high temperature generated by the drive unit due to high-speed rotation is difficult to dissipate, that is the direction that relevant manufacturers in this industry are eager to study and improve.

SUMMARY OF THE INVENTION

Therefore, in view of the above problems and deficiencies, the inventor collected relevant information, evaluated and considered it from many parties, and used his many years of experience in this industry, and after continuous creation and modification, he designed this fan anti-foreign matter structure.

The main object of the present invention is to provide a fan anti-foreign matter structure comprising a fan wheel and a fan frame. The fan wheel comprises a fan hub, an interior space with an air outlet defined in the fan hub for the mounting of a rotating shaft, a plurality of fan blades surrounding the outer surface of the fan hub, an air diversion radiator plate composing of at least one airflow guide rib and an airflow guide ring and mounted on a top surface of the interior space and surrounding the rotating shaft, and at least one air duct formed between the at least one airflow guide rib and the airflow guide ring inner peripheral surface. Each air duct has an air inlet slot formed on one side to guide the air from the interior space of the fan wheel to enter, and an airflow turning curved surface formed on the opposite side to squeeze and guide the airflow entering the respective air duct outward and discharge hot air downward, so that a positive pressure is formed at the air outlet of the fan wheel relative to the external space to prevent dirty air containing dust, salt, etc. from the external space from entering the interior space of the fan hub to accumulate in the air gap between the stator and the rotor of the fan motor or in the gap between the bearing and the rotating shaft to cause the fan to stop running. The fan frame comprises an accommodating space, an axle seat, an axle seat disk, an axle seat bracket and a fan air outlet. The accommodating space inside the axle seat of the fan frame is used for assembling the fan wheel, and a sleeve is protruded from the axle seat disk in the axle seat inside the accommodating space for the assembly of the preset rotating shaft. The axle seat disk in the axle seat is sealed, only leaving the gap between the fan hub and the bottom of the fan frame to achieve the purpose of isolating the air from the external space from entering the interior space to prevent dirty air containing dust, salt, etc. from the external space from entering the interior space of the fan hub to cause dust, salt and other foreign matter to accumulate in the air gap between the stator and the rotor of the fan motor or the gap between the bearing and the rotating shaft and cause the fan to fail and stop running.

Another object of the present invention is that the air diversion radiator plate is provided with an airflow guide ring and a plurality of airflow guide ribs surrounding the exterior of the preset rotating shaft, and the wall below the airflow guide ring in the interior space of the fan hub is equipped with a rotor magnet, and in the space between each airflow guide rib of the air diversion radiator plate and the airflow guide ring of the air diversion radiator plate, an air duct is formed from wide to narrow, extending from the outside of the rotating shaft pivot seat to each inner peripheral surface of the airflow guide ring, and the wide space on one side of the air duct forms an air inlet slot that guides external airflow in, while the narrow space on the other side of the air duct forms an airflow turning curved surface that guides the airflow to be squeezed downward and discharged outward.

Still another object of the present invention is that the air diversion radiator plate is provided with an airflow guide ring and a plurality of airflow guide ribs surrounding the exterior of the preset rotating shaft, and the wall below the airflow guide ring in the interior space of the fan hub is equipped with a rotor magnet, and the airflow guide ring inner peripheral surface is aligned with the rotor magnet inner peripheral surface to define an escape space for smooth flow of hot air, and at least one space from narrow to wide and then to narrow is formed between each airflow guide rib of the air diversion radiator plate and the airflow guide ring connecting the airflow guide ribs. The airflow guide rib extends from the outside of the rotating shaft pivot seat in a parabolic path to the airflow guide ring inner peripheral surface and is connected at an approximate tangent to form more than one air duct. The narrow to wide space on one side of the air duct close to the rotating shaft pivot seat forms the air inlet slot that guides the air in the interior space of the fan hub to enter, and at the narrowest space in the space from wide to narrow on the other side of the air duct forms the airflow turning curved surface to guide the airflow to be squeezed downward and discharged outward.

Still another object of the present invention is that the fan wheel is provided with a rotor magnet on wall of the interior space of the fan hub, and a plurality of stator silicon steel sheet sets of a preset motor are provided on the outside of the axle seat of the fan frame relative to the rotor magnet, and each stator silicon steel sheet set includes a plurality of inner silicon steel sheets, a plurality of outer silicon steel sheets, and enameled wire winding sets wound the plurality of inner silicon steel sheets and the plurality of outer silicon steel sheets, and airflow ducts are formed between the plurality of outer silicon steel sheets, the enameled wire winding sets and the inner silicon steel sheets of each stator silicon steel sheet, and an escape space is formed between the rotor magnet and the plurality of outer silicon steel sheets.

Still another object of the present invention is that each stator silicon steel sheet set includes a plurality of inner silicon steel sheets, a plurality of outer silicon steel sheets and enameled wire winding sets wound the plurality of inner silicon steel sheets and the plurality of outer silicon steel sheets, and each stator silicon steel sheet set and the circuit board can be provided with air-isolating, dust-proof, and waterproof coating or glue-filling operations to form a protective layer.

Still another object of the present invention is that the axle seat inside the fan frame is in a U shape or a ⊓ shape, a sleeve is protruded inside the accommodating space of the U-shaped axle seat, and a circuit board is provided on the outside of the sleeve; in addition, a circuit board is installed outside the bottom of the ⊓-shaped axle seat, and the axle seat has a receiving space extending downward, and a static impeller pressure plate or axle seat disk bracket extends radially outward of the receiving space.

Still another object of the present invention is that the fan anti-foreign matter structure comprises a fan wheel and a fan frame. The fan wheel comprises a fan hub, an interior space defined in the fan hub for the mounting of a rotating shaft, a plurality of fan blades surrounding the outer surface of the fan hub, a rotating shaft bearing seat set in the interior space, and an air diversion radiator plate mounted on the top surface of the internal space and surrounding the rotating shaft bearing seat set. The air diversion radiator plate comprises at least one airflow guide rib and an airflow guide ring, at least one air duct formed between the at least one airflow guide rib and the airflow guide ring, an air inlet slot formed on one side of each air duct to guide the air in the interior space of the fan hub to enter the respective air duct, and an airflow turning curved surface formed on an opposite side of each air duct to guide the entered airflow to be squeezed and discharged outward. The fan frame comprises an accommodating space, an axle seat, an axle seat disk, an axle seat bracket and a fan air outlet. A sleeve is set on the axle seat disk in the axle seat, a receiving space is defined in the sleeve for the assembly of a fan wheel rotating shaft bearing seat, and a rotating shaft inside the receiving space is used for the assembly of the fan wheel rotating shaft bearing seat. The axle seat disk in the axle seat is sealed, and after the fan wheel is assembled into the accommodating space of the fan frame, only the gap between the fan hub and the axle seat disk of the fan frame or the gap between the fan hub and the circuit board on the axle seat disk (that is, the air outlet of the interior space inside the fan hub) is left, so that when the fan rotates, the air outlet of the interior space inside the fan hub forms a positive pressure relative to the external space to prevent dirty air containing dust, salt, etc. from the external space from entering the interior space of the fan hub to cause the fan to stop running.

Still another object of the present invention is that the air diversion radiator plate comprises the airflow guide ring surrounding the rotating shaft bearing seat and a plurality of airflow guide ribs; the wall below the airflow guide ring in the interior space of the fan hub is provided with a rotor magnet; the space between the at least one airflow guide rib of the air diversion radiator plate and the airflow guide ring of the air diversion radiator plate forms at least one air duct from wide to narrow extending from the outside of a rotating shaft pivot seat to an airflow guide ring inner peripheral surface, so that the wide space on one side of each air duct forms the air inlet slot that guides the air in the fan hub to enter, and the narrow space on the opposite side of each air duct forms the airflow turning curved surface to guide the entered airflow to be squeezed downward and discharged outward.

Still another object of the present invention is that the air diversion radiator plate comprises the airflow guide ring surrounding the rotating shaft bearing seat and a plurality of airflow guide ribs; the wall below the airflow guide ring in the interior space of the fan hub is provided with a rotor magnet; the airflow guide ring inner peripheral surface is aligned with the rotor magnet inner peripheral surface and forms an escape space between the plurality of outer silicon steel sheets for hot air to pass through smoothly; at least one space from narrow to wide and then to narrow is formed between each airflow guide rib and the airflow guide ring; each airflow guide rib extends from the outside of the rotating shaft pivot seat in a parabolic path to the airflow guide ring inner peripheral surface and is connected at an approximate tangent to form at least one air duct, so that the air inlet slot that guides the airflow in the interior space of the fan hub to enter is formed in the space from narrow to wide on one side of the air duct close to the rotating shaft pivot seat, and the airflow turning curved surface is formed at the narrowest space in the space from wide to narrow on the opposite side of the air duct to guide the airflow to be squeezed downward and discharged outward.

Still another object of the present invention is that there is a rotor magnet on the wall of the interior space of the fan hub, and a plurality of stator silicon steel sheet sets of the preset motor are provided outside the sleeve of the axle seat of the fan frame relative to the rotor magnet. Each stator silicon steel sheet set includes a plurality of inner silicon steel sheets, a plurality of outer silicon steel sheets, and enameled wire winding sets wound the plurality of inner silicon steel sheets and the plurality of outer silicon steel sheets. An airflow duct is formed between the plurality of inner silicon steel sheets, the plurality of outer silicon steel sheets, and the enameled wire winding of each stator silicon steel sheet set, and an escape space is formed between the rotor magnet and the plurality of outer silicon steel sheets.

Still another object of the present invention is that there is a circuit board for electrical connection with each stator silicon steel sheet set of the preset motor is provided on the outside of the sleeve of the axle seat inside the fan frame, and an airflow channel is formed on the circuit board for airflow to pass through. The airflow channel can be located on the circuit board, or between the circuit board and the sleeve of the axle seat. The axle seat inside the fan frame is U-shaped or ⊓-shaped. A sleeve is protruded inside the accommodating space of the U-shaped axle seat, and the outside of the sleeve is equipped with a circuit board. In addition, a circuit board installed under the bottom of the ⊓-shaped axle seat.

Still another object of the present invention is that the axle seat has a receiving space extending downward, and a static impeller pressure plate or axle seat disk bracket extends radially outward of the receiving space.

DETAILED DESCRIPTION OF THE INVENTION

In order to achieve the above objects and effects, the technical means used in the present invention, their structures, implementation methods, etc. are hereby described in detail with reference to the preferred embodiments of the present invention and their features and functions are as follows to facilitate a complete understanding.

Figure 5:
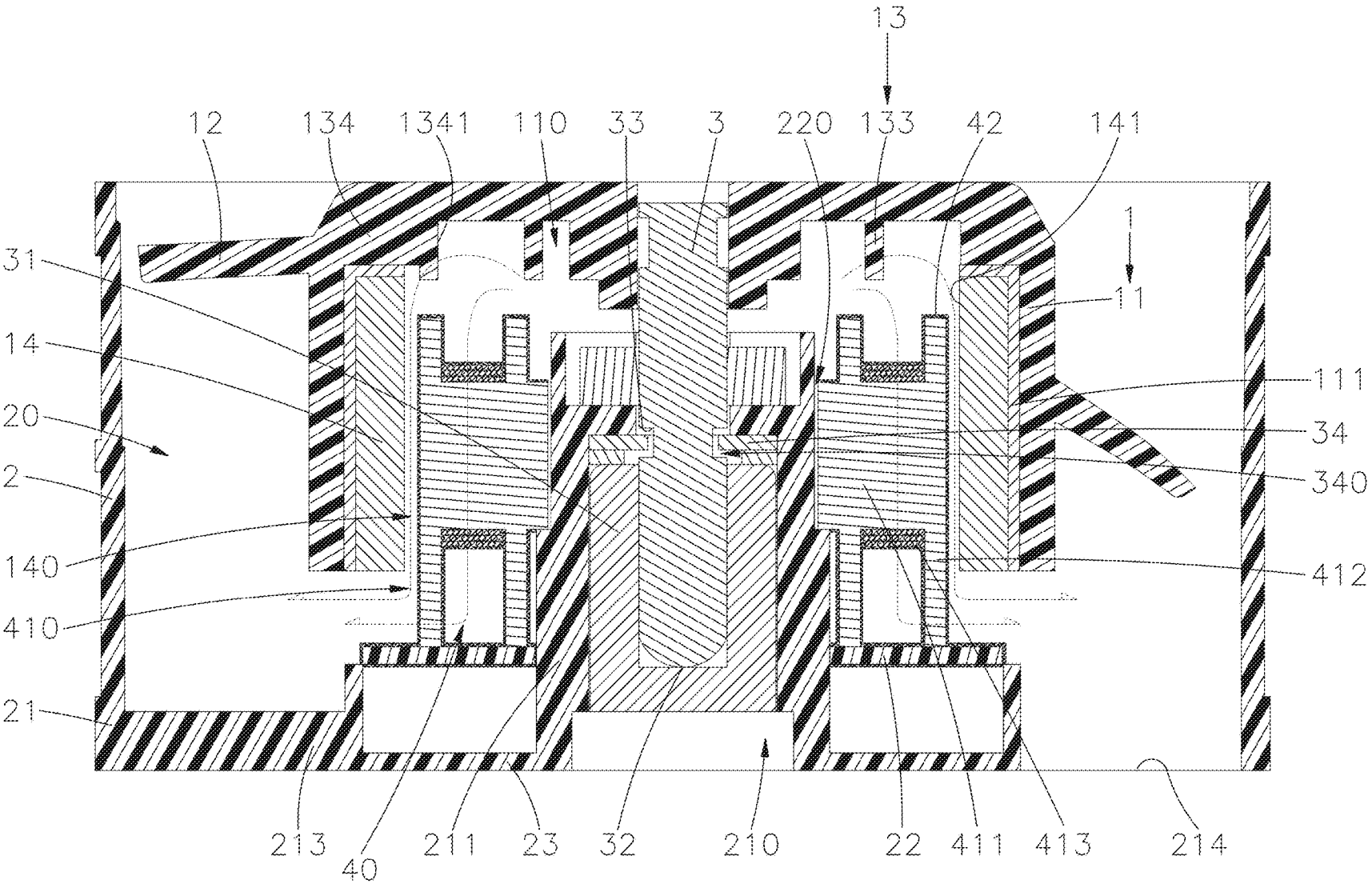
FIG. 5 is a side cross-sectional view of the first embodiment of the present invention (coated, with an airflow duct).
Figure 6:
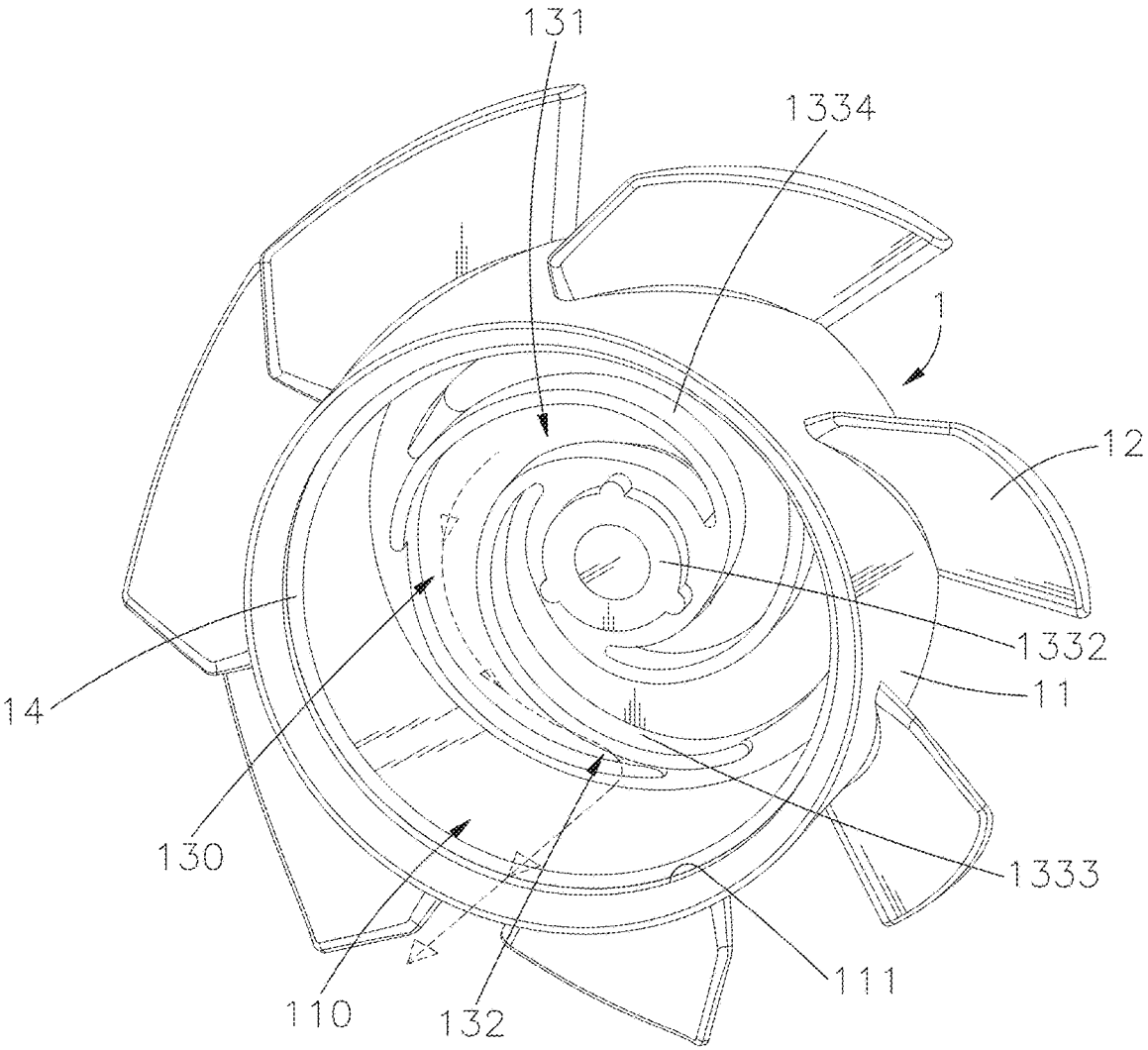
FIG. 6 is a three-dimensional appearance view of the second embodiment of the fan wheel of the present invention.

Please refer to FIGS. 1-14, it can be clearly seen from the figures that the fan anti-foreign matter structure of the present invention comprises a fan wheel 1 and a fan frame 2 (please also refer to FIG. 5, which is coated and has an airflow duct 40).

The fan wheel 1 comprises a fan hub 11 and a plurality of fan blades 12 surrounding its outer surface. The fan hub 11 is provided with an interior space 110 inside, and a rotor magnet 14 is provided on the wall 111 of the interior space 110, and a preset rotating shaft 3 can be inserted therein. The top surface of the internal space 110 is provided with an air diversion radiator plate 13 surrounding the exterior of the preset rotating shaft 3. The air diversion radiator plate 13 is composed of at least one airflow guide rib 133 and an airflow guide ring 134. At least one air duct 130 is formed between the airflow guide ring inner peripheral surface 1341 and the airflow guide rib 133. One side of the air duct 130 is an air inlet slot 131 that guides the air from the interior space 110 to enter, and the other side forms an airflow turning curved surface 132 that can squeeze and guide the airflow to turn outward and to discharge hot air downward. This allows the air outlet of the interior space 110 relative to the external space to form a positive pressure to prevent dirty air containing dust, salt, etc. from the external space from entering the interior space 110 and causing dust, salt and other foreign matter to accumulate on the air gap between the stator silicon steel sheet sets 41 of the fan motor 4 and the rotor magnet 14 or the gap between the bearing 31 and the rotating shaft 3 to cause the fan to stop running.

Figure 1:
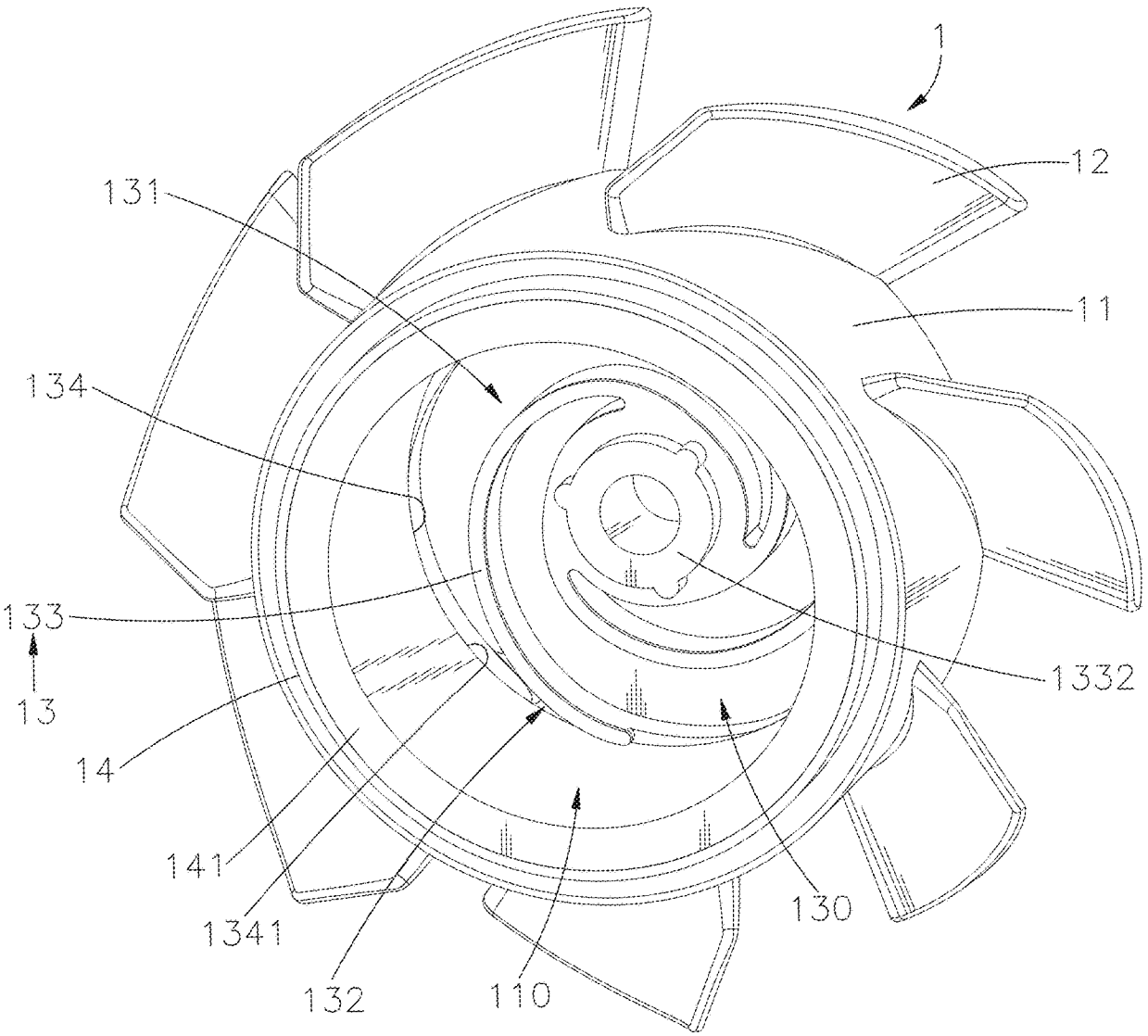
FIG. 1 is a three-dimensional appearance view of the first embodiment of the fan wheel of the present invention.
Figure 2:
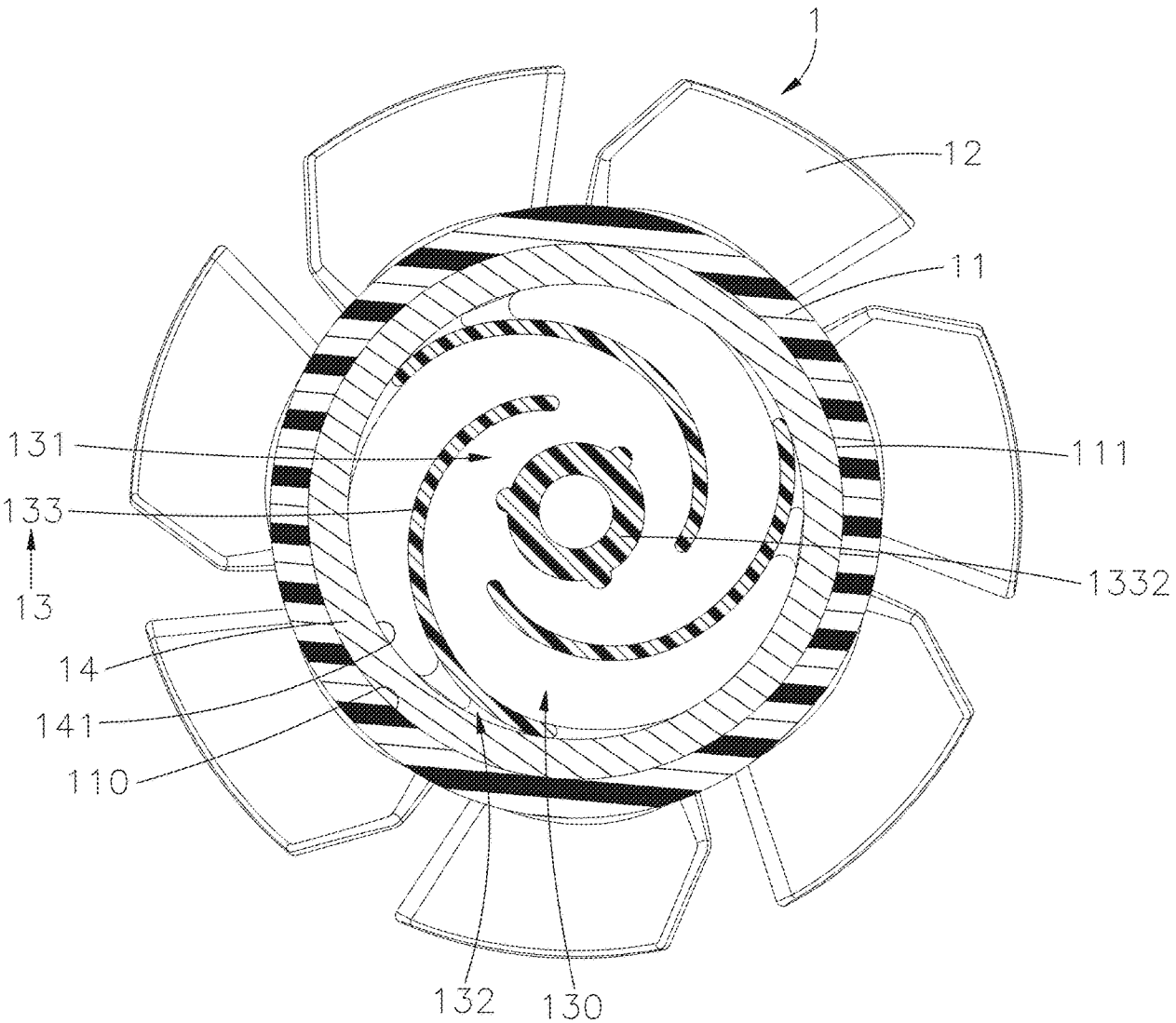
FIG. 2 is a schematic plan view of the first embodiment of the fan wheel of the present invention.
Figure 3:
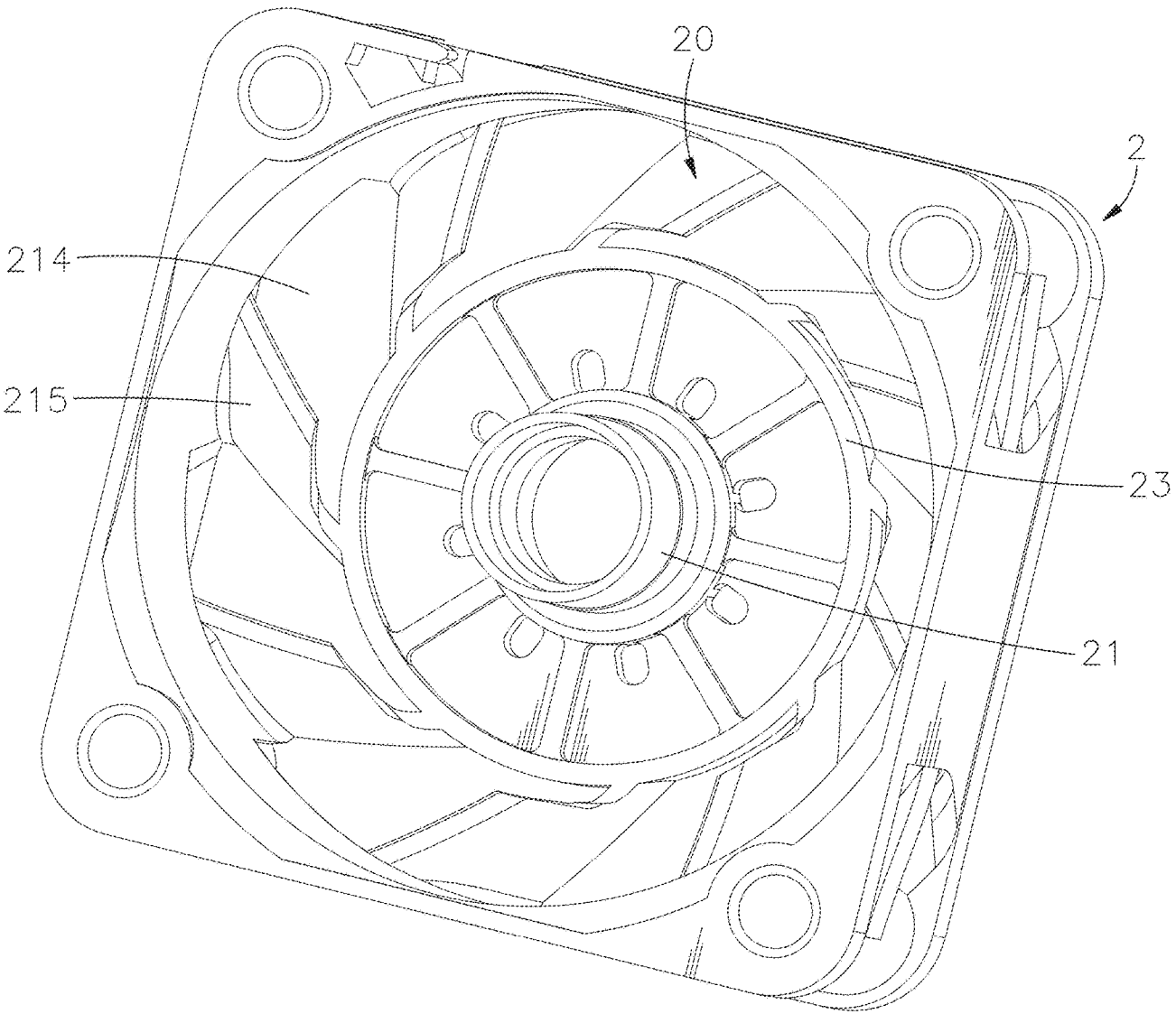
FIG. 3 is a three-dimensional appearance of the fan frame of the present invention.
Figure 4:
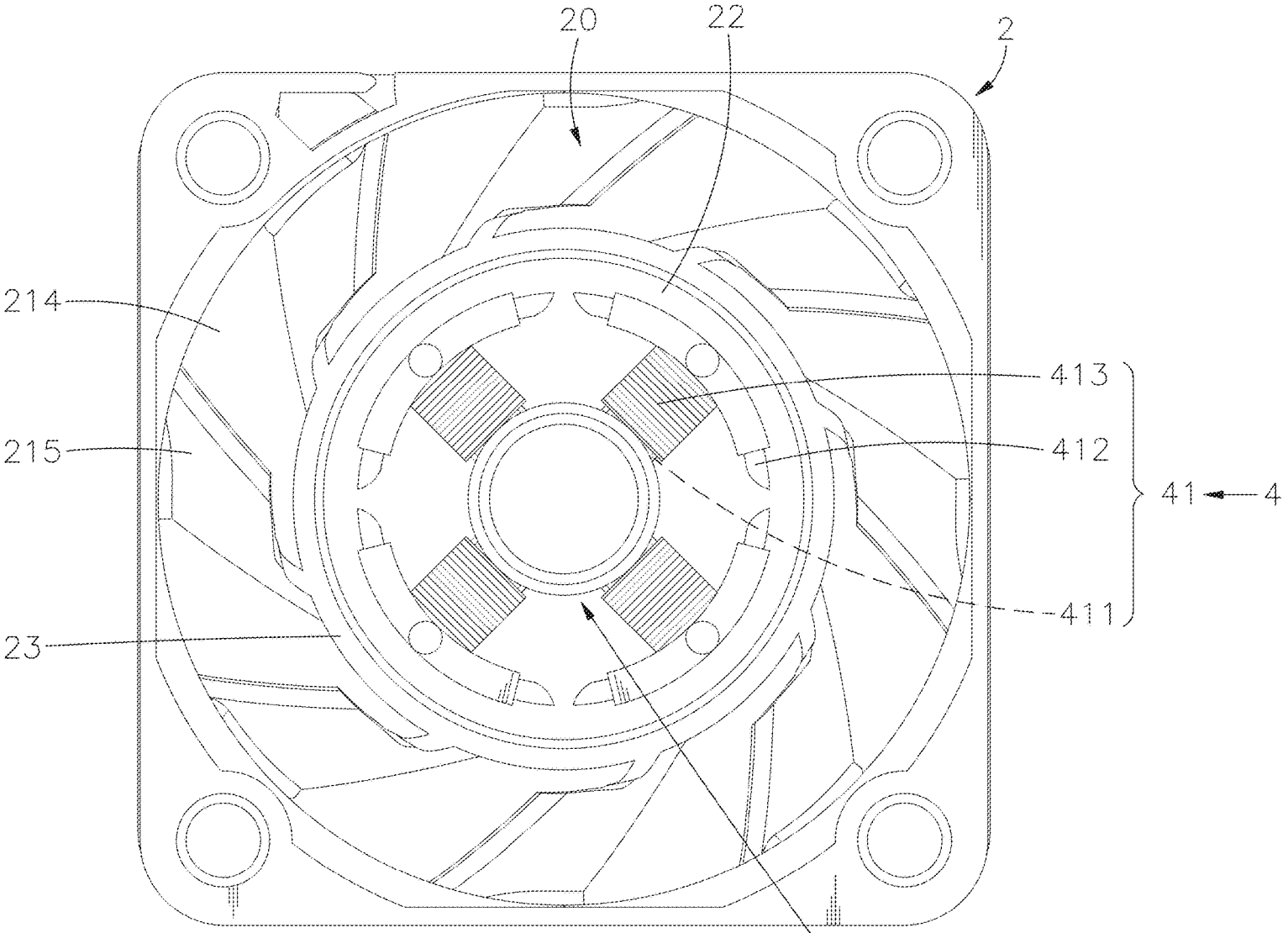
FIG. 4 is a top view of the fan frame and stator silicon steel sheet set of the present invention.

Please refer to FIG. 2, which is a schematic plan view of the first embodiment of the fan wheel 1 of the present invention and is accompanied by all finished product embodiments. The wall 111 below the airflow guide ring 134 in the interior space 110 of the fan hub 11 is equipped with a rotor magnet 14, and the airflow guide ring inner peripheral surface 1341 is connected to the rotor magnet inner peripheral surface 141 in flush to facilitate the smooth flow of air through the escape space 140. At least one space from wide to narrow is formed between each airflow guide rib 133 of the air diversion radiator plate 13 and the airflow guide ring 134 of the air diversion radiator plate 13 to form the air duct 130, that is, the airflow guide rib 133 extends from the outside of the rotating shaft pivot seat 1332 to the airflow guide ring inner peripheral surface 1341 in a parabolic path, and is connected at an approximate tangent to form at least one air duct 130. The wide space on one side of the air duct 130 forms an air inlet slot 131 that guides the external airflow to enter, and the narrow space on the other side of the air duct 130 forms the airflow turning curved surface 132 that guides the airflow to be squeezed downward and discharged outward. An escape space 140 is formed between the rotor magnet inner peripheral surface 141 and the outer silicon steel sheets 412 for the extruded hot air to be discharged outward.

Figure 8:
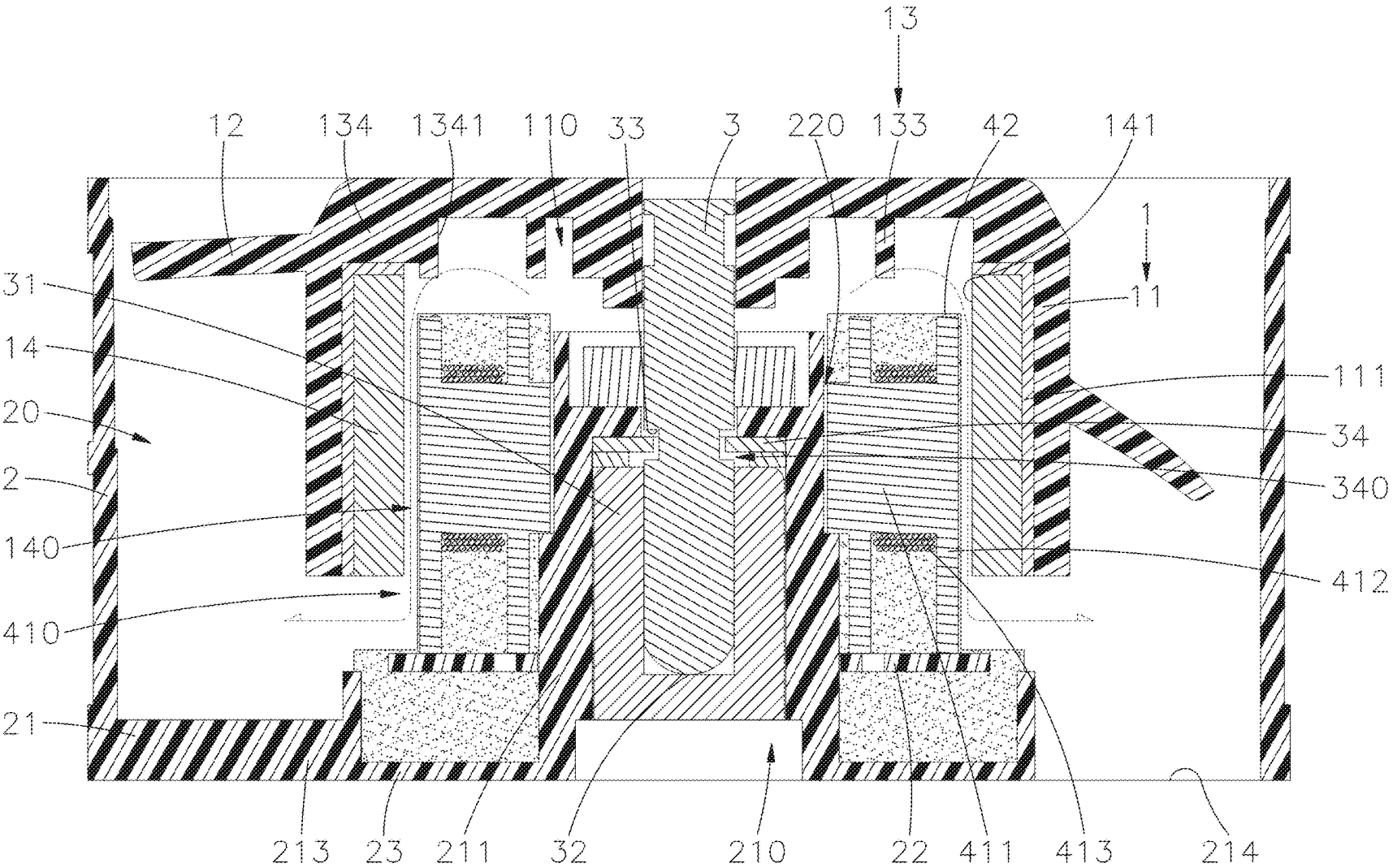
FIG. 8 is a side cross-sectional view of the third embodiment of the present invention (glue filling, and no airflow duct).
Figure 9:
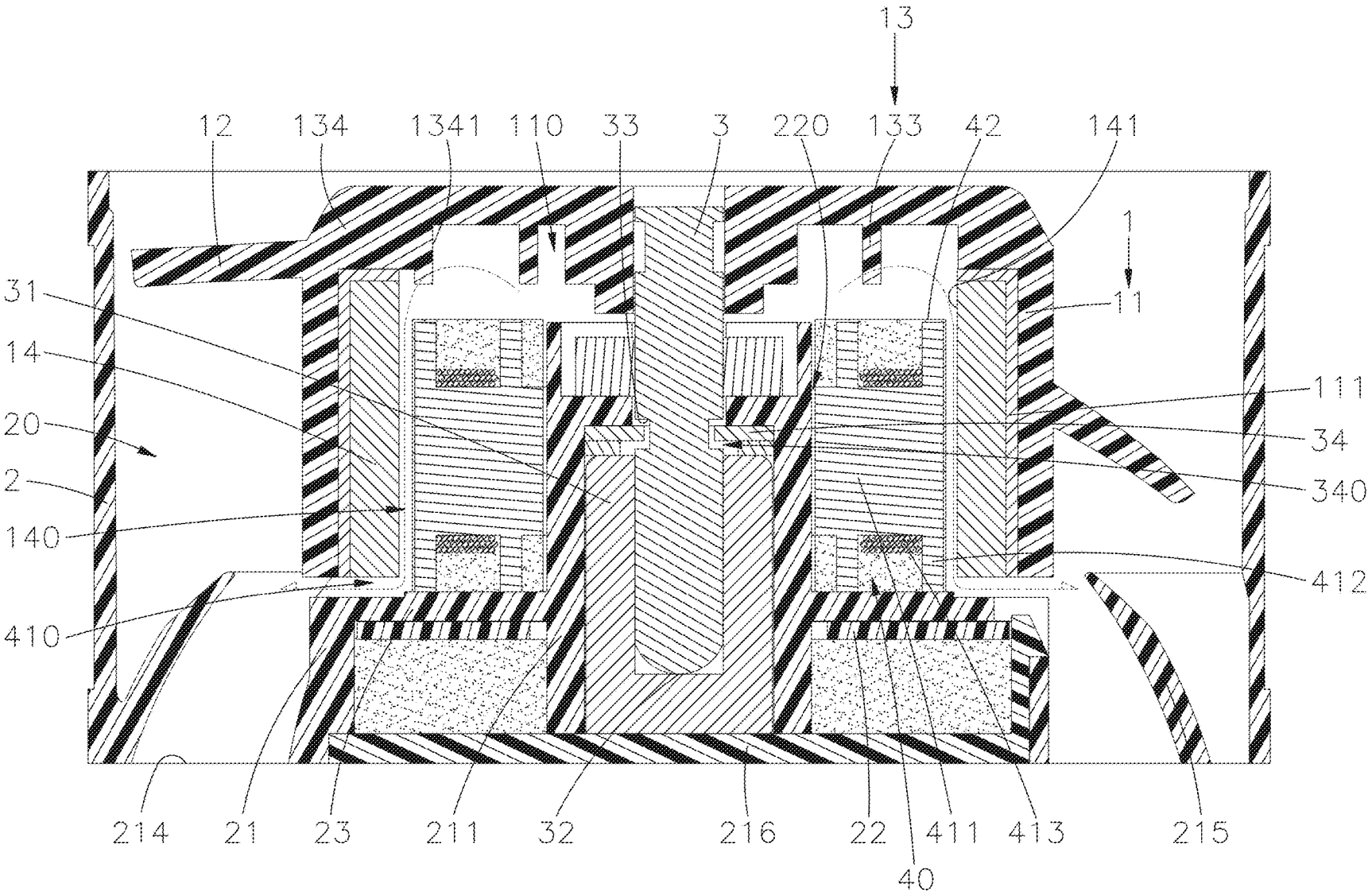
FIG. 9 is a side cross-sectional view of the fourth embodiment of the present invention (glue filling, and no airflow duct).

The fan frame 2 is provided with an accommodating space 20 inside for assembling the fan wheel 1, that is, an axle seat disk 23 is provided at the center of the axle seat 21 inside the accommodating space 20. A bracket and an air outlet are provided around the axle seat disk 23. The center of the axle seat disk 23 is protrudingly provided with a sleeve 211, which can be used for assembly of the preset rotating shaft 3 at the center of the sleeve 211. The bottom of the accommodating space 20 outside the axle seat 21 is opposite to the interior space 110 of the fan hub 11. A circuit board 22 is provided on the axle seat 21 in the accommodating space 20, and a plurality of stator silicon steel sheet sets 41 (including a plurality of inner silicon steel sheets 411, a plurality of outer silicon steel sheets 412 and enameled wire winding sets 413) of the preset motor 4 are provided on the circuit board 22. Each stator silicon steel sheet set 41 is in I shape arranged around the sleeve 211 of the axle seat 21. An airflow duct 40 is formed between the plurality of inner silicon steel sheets 411, the plurality of outer silicon steel sheets 412 and the enameled wire winding set 413 of each I-shaped stator silicon steel sheet set 41 and the axle seat 21 (please also refer to FIG. 5, which is coated and has an airflow duct 40). An escape space 140 is formed between each stator silicon steel sheet set 41 of the preset motor 4 and the adjacent rotor magnet 14. Each stator silicon steel sheet set 41 of the preset motor 4 comprises a plurality of inner silicon steel sheets 411, a plurality of outer silicon steel sheets 412, and an enameled wire winding set 413 wound on the plurality of inner silicon steel sheets 411 and the plurality of outer silicon steel sheets 412. Each stator silicon steel sheet set 41 and the circuit board 22 can be equipped with different levels of air isolation, dustproof, and waterproof coating or glue filling operations to form a protective layer 42 to isolate air and water from entering, thereby achieving the purposes of dustproof, waterproof, etc. (please also refer to FIG. 5, FIG. 7 and FIG. 13). The coating method can retain the airflow duct 40 and airflow channel 410 because the protective layer 42 is thin. The glue filling method is as shown in FIGS. 8, 9, and 14. Due to the glue filling, the airflow duct 40 and airflow channel 410 are filled, only leaving the interior space 110 above the stator. The fan frame 2 is provided with an accommodating space 20 for assembling the fan wheel 1. A sleeve 211 is protruding from the axle seat 21 inside the accommodating space 20 of the fan frame 2 for the assembly of the preset rotating shaft 3. Then the axle seat disk 23 of the axle seat 21 is sealed (no opening), only leaving the gap between the fan hub 11 of the fan wheel 1 and the axle seat disk 23 or the circuit board 22 at the bottom of the fan frame 2, which is the fan hub interior space air outlet 142. This achieves the purpose of isolating the air from the external space from entering the interior space 110 to prevent the dirty air containing dust, salt, etc. from the external space from entering the interior space 110 and causing accumulation of dust, salt and other foreign matter in the air gap between the stator silicon steel sheet sets 41 of the fan motor 4 and the rotor magnet 14 or the gap between the bearing 31 and the rotating shaft 3 to cause the fan to fail and stop running.

The above-mentioned fan wheel 1 of the present invention forms at least one air duct 130 in the space between each airflow guide rib outer peripheral surface 1334 and the airflow guide ring inner peripheral surface 1341 of the interior space 110 of the fan hub 11 for guiding airflow to enter. The wide space on one side of the air duct 130 forms an air inlet slot 131, which guides the internal air of the interior space 110 (if the coating method is used, the internal air includes the air in the space between the plurality of inner silicon steel sheets 411, the plurality of outer silicon steel sheets 412 and the enameled wire winding sets 413 of the preset motor 4; if the glue filling method is used, the internal air will only be the air in the space inside the interior space 110 that has not been filled with glue) to enter the air inlet slot 131, so that the air entered the air inlet slot 131 can be squeezed toward the airflow turning curved surface 132 of the narrow space on the other side of the air duct 130 to further flow, turn, and be discharged outward through the escape space 140 between the rotor magnet 14 and the outer silicon steel sheets 412. This allows the interior space 110 to form a positive pressure at the gap between the bottom of the fan hub 11 and the axle seat 21, that is, at the fan hub interior space air outlet 142 (the only air outlet) relative to the external space. This positive pressure prevents dirty air containing dust, salt, etc. from the external space from entering the interior space 110 and causing foreign matter such as dust, salt, etc. to accumulate in the air gap between the stator silicon steel sheet sets 41 of the fan preset motor 4 and the rotor magnet 14 (i.e., the escape space 140) or the gap between the bearing 31 and the preset rotating shaft 3 to further cause the fan to stop running (coating and glue filling provide each stator silicon steel sheet set 41 and the circuit board 22 with a protective layer 42 that isolates air, dust and water from entering, thereby achieving the purposes of dust-proof, waterproof, etc. Even if it is not coated or filled with glue, dust, salt, etc. will be blocked from entering the interior space 110 by using the air diversion radiator plate 13 to extend the service life of the fan).

Figure 7:
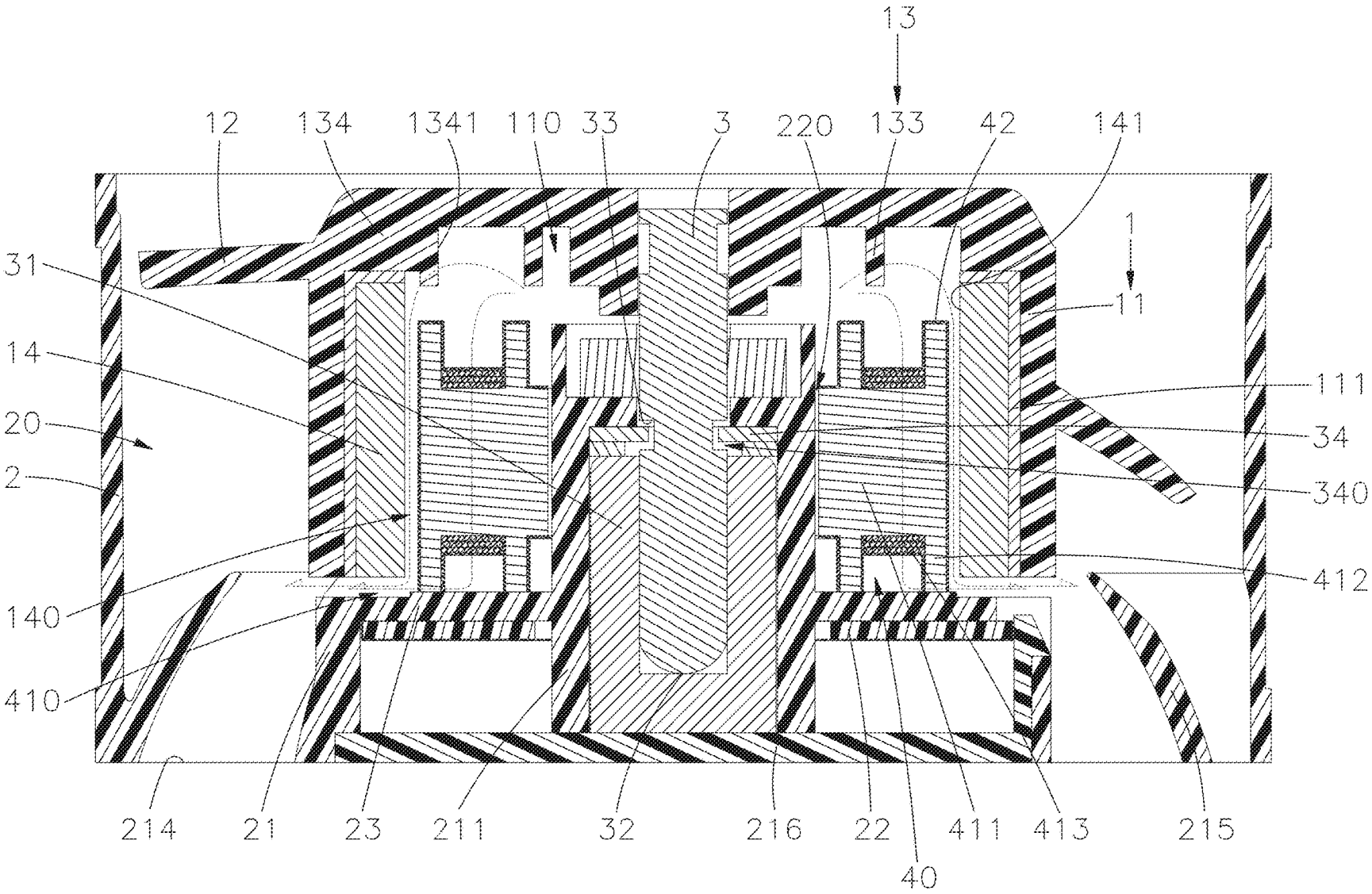
FIG. 7 is a side cross-sectional view of the second embodiment of the present invention (coated, with an airflow duct).
Figure 13:
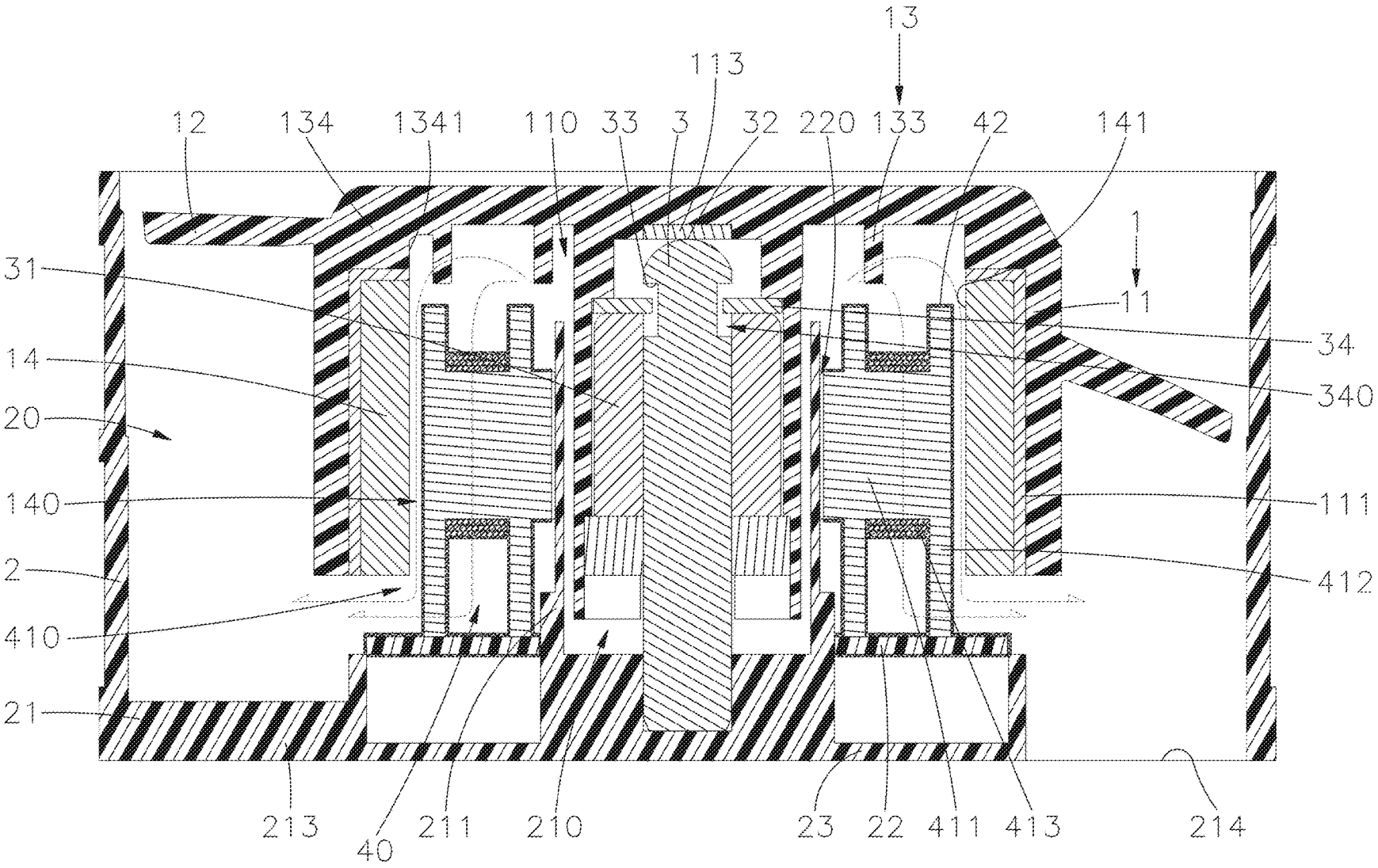
FIG. 13 is a side cross-sectional view of the fifth embodiment of the present invention (coated, with an airflow duct).
Figure 14:
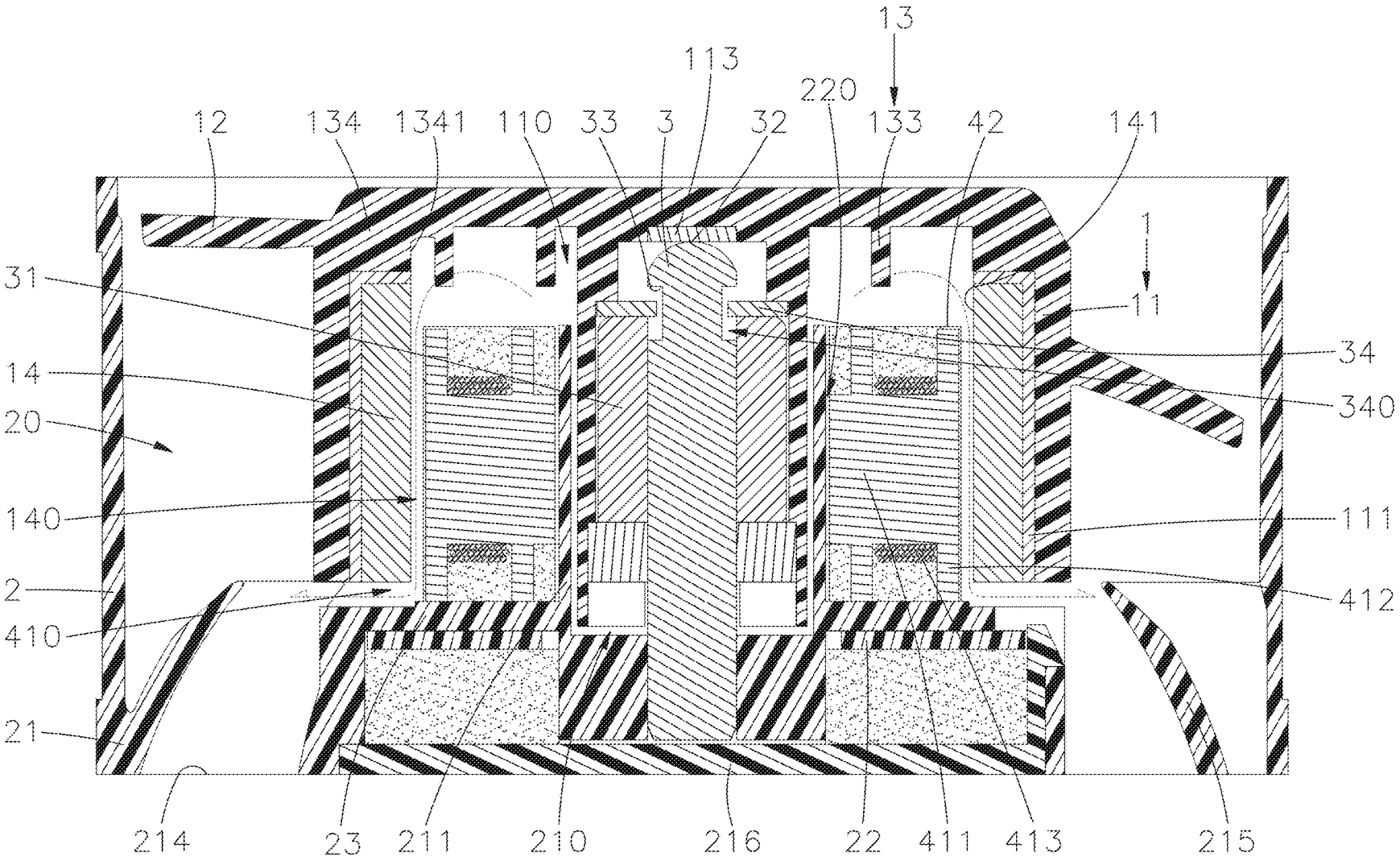
FIG. 14 is a side cross-sectional view of the sixth embodiment of the present invention (glue filling, and no airflow duct).

Please also refer to FIG. 5, FIG. 7, and FIG. 13. The coating method can retain the airflow duct 40 and the airflow channel 410 because the protective layer 42 is thin. Assume that there is an air flow channel 220 in the middle of the circuit board 22 or between the circuit board 22 and the axle seat 21. There is an accommodating space 20 inside the fan frame 2 for assembling the fan wheel 1, that is, a sleeve 211 is protruding from the axle seat 21 inside the accommodating space 20, and the preset rotating shaft 3 can be assembled at the sleeve 211, and a circuit board 22 is provided on the axle seat 21 in the accommodating space 20. The circuit board 22 is provided with a plurality of stator silicon steel sheet sets 41 of the preset motor 4 (including a plurality of inner silicon steel sheets 411, a plurality of outer silicon steel sheets 412 and enameled wire winding sets 413; each stator silicon steel sheet set 41 and the circuit board 22 can be provided with air-isolating, dust-proof, and waterproof coating or glue filling operations to form a protective layer 42 to isolate air and water from entering, thereby achieving the purposes of dust-proof, waterproof, etc.). Each stator silicon steel sheet set 41 is in I shape arranged around the axle seat 21. An airflow duct 40 is formed between the plurality of inner silicon steel sheets 411, the plurality of outer silicon steel sheets 412 and the enameled wire winding set 413 of each I-shaped stator silicon steel sheet set 41 and the axle seat 21. An air flow channel 220 is formed in the middle of the circuit board 22 or between the circuit board 22 and the axle seat 21. An escape space 140 is formed between each stator silicon steel sheet set 41 of the preset motor 4 and the adjacent rotor magnet 14.

The above-mentioned fan wheel 1 of the present invention forms at least one air duct 130 in the space between each airflow guide rib outer peripheral surface 1334 and the airflow guide ring inner peripheral surface 1341 of the interior space 110 of the fan hub 11 for guiding airflow to enter. The wide space on one side of the air duct 130 forms an air inlet slot 131, which guides the internal air of the interior space 110 to enter the air inlet slot 131, so that the air entered the air inlet slot 131 can be squeezed toward the airflow turning curved surface 132 of the narrow space on the other side of the air duct 130 to further flow, turn, and be discharged outward through the escape space 140 between the rotor magnet 14 and the outer silicon steel sheets 412. This allows the interior space 110 to form a positive pressure at the gap between the bottom of the fan hub 11 and the axle seat 21, that is, at the fan hub interior space air outlet 142 (the only air outlet) relative to the external space. This positive pressure prevents dirty air containing dust, salt, etc. from the external space from entering the interior space 110 and causing foreign matter such as dust, salt, etc. to accumulate in the air gap between the stator silicon steel sheet sets 41 of the fan preset motor 4 and the rotor magnet 14 (i.e., the escape space 140) or the gap between the bearing 31 and the preset rotating shaft 3 to further cause the fan to stop running.

Also, please refer to FIGS. 8, 9 and 14. The airflow duct 40 and the airflow channel 410 are all filled due to the glue filling, only leaving the interior space 110 above the stator. The bottom of the accommodating space 20 outside the axle seat 21 is aligned with the interior space 110 of the fan hub 11 of the fan wheel 1 of the present invention, and a circuit board 22 is provided on the axle seat 21 in the accommodating space 20. The circuit board 22 is provided with a plurality of stator silicon steel sheet sets 41 of the preset motor 4 (including a plurality of inner silicon steel sheets 411, a plurality of outer silicon steel sheets 412 and enameled wire winding sets 413; each stator silicon steel sheet set 41 and the circuit board 22 can be processed with a air-isolating, dust-proof, and waterproof glue filling operations to form a protective layer 42 to isolate the air and water from entering, thereby achieving the purposes of dustproof, waterproof, etc.). Each stator silicon steel sheet set 41 is in I shape arranged around the axle seat 21. An airflow duct 40 is formed between the plurality of inner silicon steel sheets 411, the plurality of outer silicon steel sheets 412 and the enameled wire winding set 413 of each I-shaped stator silicon steel sheet set 41. An air flow channel 220 is formed between the circuit board 22 and the axle seat 21. The wall 111 of the interior space 110 of the fan hub 11 is equipped with a rotor magnet 14. An escape space 140 is formed between the rotor magnet 14 and the plurality of outer silicon steel sheets 412 for air flow to pass through and be discharged outward. By the rotation of the air diversion radiator plate 13, the remaining air in the interior space 110 is squeezed to turn downward through the airflow turning curved surface 132, and is discharged outward along the escape space 140, forming a positive pressure outside the interior space 110. The formation of the positive pressure achieves the purpose of isolating the air from the external space from entering the interior space 110 and preventing the dirty air containing dust, salt, etc. from the external space from entering the interior space 110 to cause dust, salt and other foreign matter to accumulate in the air gap between the stator silicon steel sheet sets 41 of the fan motor 4 and the rotor magnet 14 or the gap between the bearing 31 and the rotating shaft 3 to further cause the fan to fail and stop running. The axle seat 21 of the fan frame 2 is equipped with a U-shaped bearing 31 inside, and a circuit board 22 is set on the outside of the sleeve 211 of the axle seat 21, and the bottom is covered with an axle seat cover 216, so that the circuit board 22 can be electrically connected to each stator silicon steel sheet set 41 of the preset motor 4.

The fan wheel 1 of the present invention is provided with a plurality of fan blades 12 surrounding the fan hub 11 and its outer surface. The fan hub 11 is provided with an interior space 110 inside, and the wall 111 of the interior space 110 is equipped with a rotor magnet 14 and can be installed with a preset rotating shaft 3. The top surface of the interior space 110 is provided with an air diversion radiator plate 13 surrounding the preset rotating shaft 3. The air diversion radiator plate 13 is composed of at least one airflow guide rib 133 and an airflow guide ring 134. The wall 111 below the airflow guide ring 134 in the interior space 110 of the fan hub 11 is equipped with a rotor magnet 14. The airflow guide ring inner peripheral surface 1341 is connected to the rotor magnet inner peripheral surface 141 in flush to facilitate the smooth flow of air through the escape space 140, and at least one space from wide to narrow is formed between each airflow guide rib 133 of the air diversion radiator plate 13 and the airflow guide ring 134 of the air diversion radiator plate 13 to form the air duct 130. In order to achieve a better airflow blocking effect, the airflow guide rib 133 extends from the outside of the rotating shaft pivot seat 1332 to the airflow guide ring inner peripheral surface 1341 in a parabolic path, and is connected at an approximate tangent to form at least one air duct 130. The wide space on one side of the air duct 130 forms an air inlet slot 131 that guides the external airflow to enter, and the narrow space on the other side of the air duct 130 forms an airflow turning curved surface 132 that guides the airflow to be squeezed downward and discharged outward. An escape space 140 is formed between the airflow guide ring inner peripheral surface 1341 and the outer silicon steel sheets 412. By the rotation of the air diversion radiator plate 13, the air in the interior space 110 is squeezed and turned downward through the airflow turning curved surface 132, and then is discharged outward along the escape space 140 and a positive pressure is formed outside the interior space 110 to achieve the purpose of isolating the air from the external space from entering the interior space 110 and preventing the dirty air containing dust, salt, etc. from the external space from entering the interior space 110 to avoid dust, salt and other foreign matter accumulating in the air gap between the stator silicon steel sheet sets 41 of the fan motor 4 and the rotor magnet 14 or the air gap between the bearing 31 and the rotating shaft 3 to further cause the fan to fail and stop running. The axle seat 21 of the fan frame 2 is equipped with a U-shaped bearing 31 inside, and a circuit board 22 is set on the outside of the sleeve 211 of the axle seat 21, and the bottom is covered with an axle seat cover 216, so that the circuit board 22 can be electrically connected to each stator silicon steel sheet set 41 of the preset motor 4.

Figure 10:
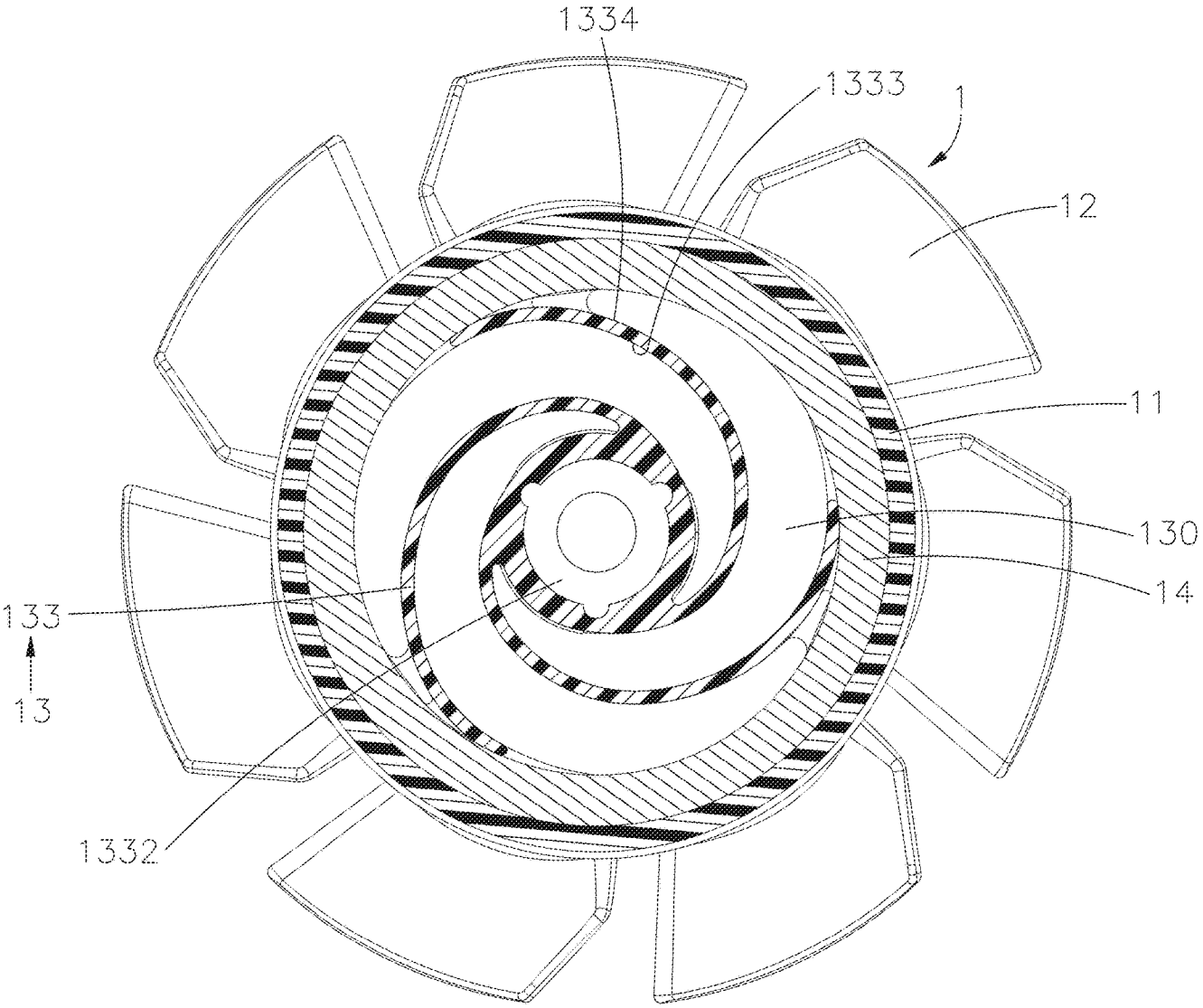
FIG. 10 is a bottom view of the fan wheel according to the second embodiment of the fan wheel of the present invention.
Figure 11:
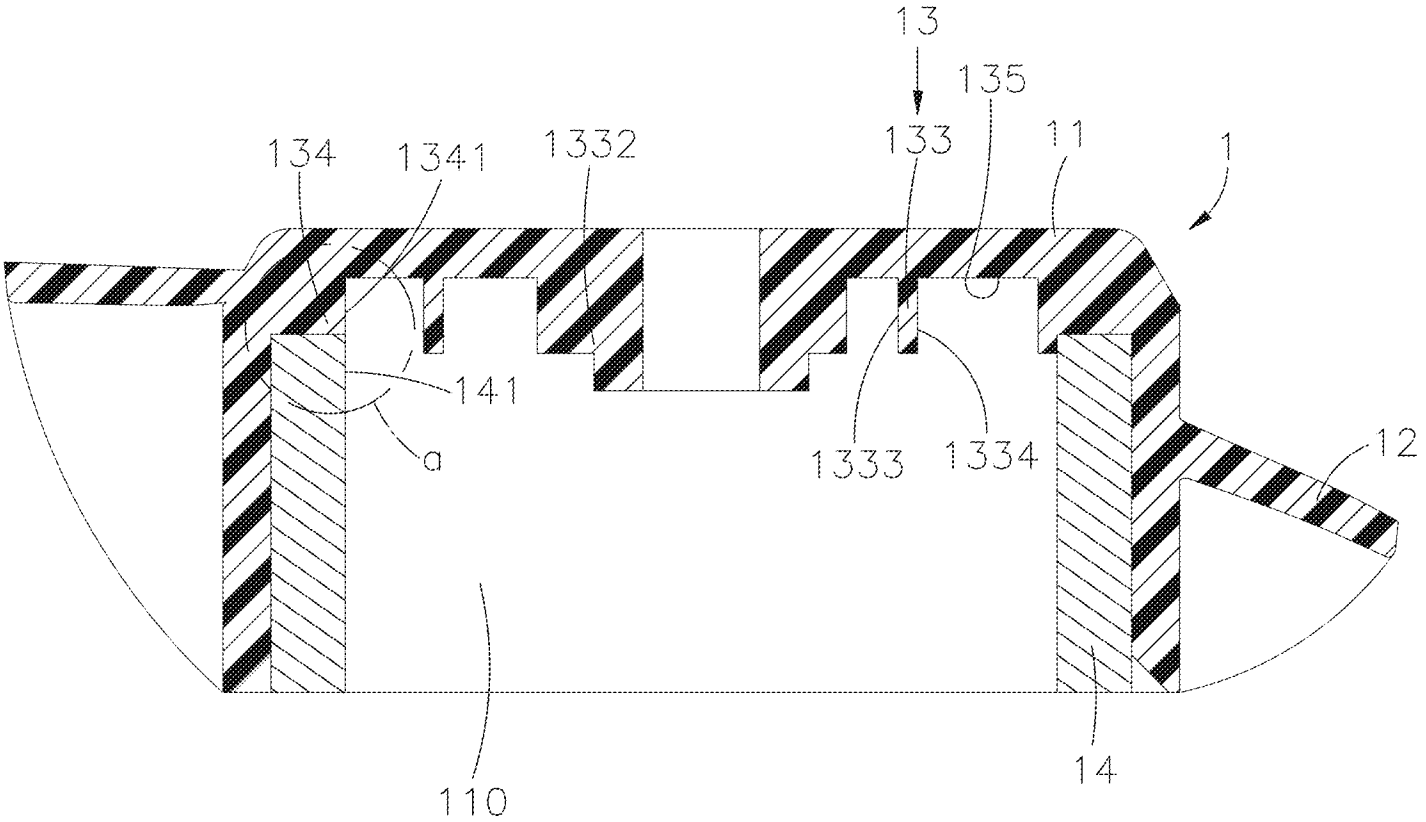
FIG. 11 is a side cross-sectional view of the fan wheel according to the first embodiment of the fan wheel of the present invention.
Figure 12:
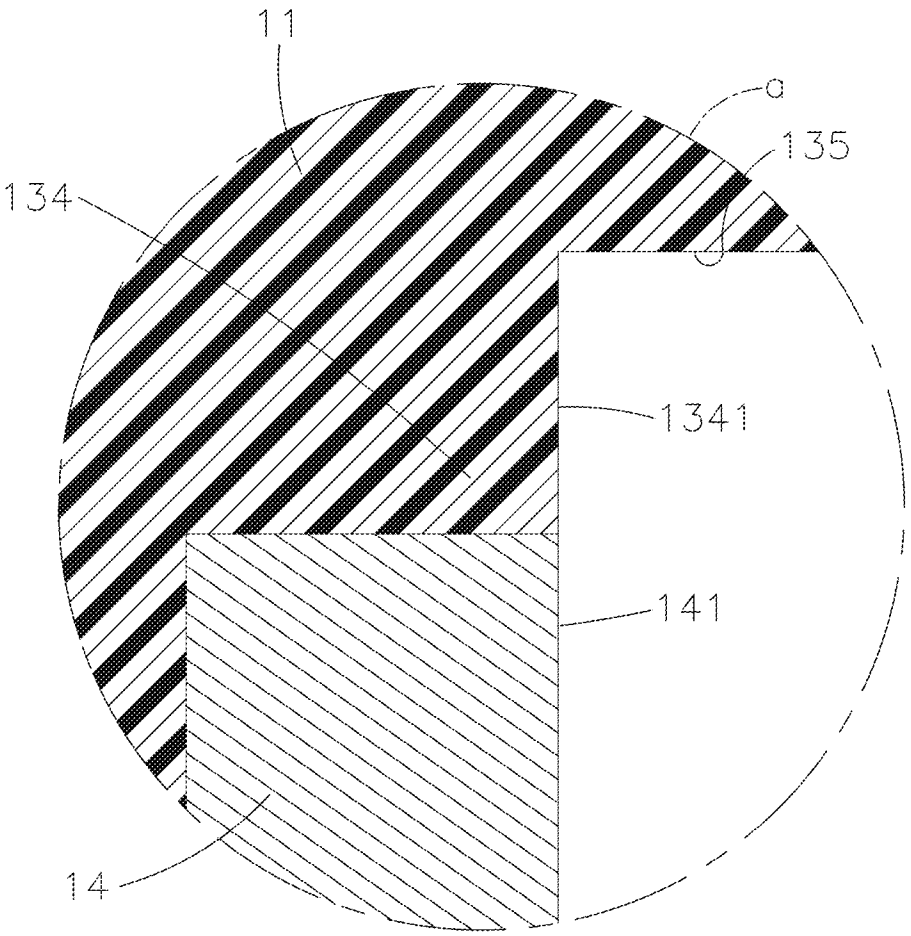
FIG. 12 is a partial enlarged view of part a of FIG. 11 of the present invention.

In addition, please refer to FIG. 10, which is a bottom view of the fan wheel 1 according to the second embodiment of the fan wheel 1 of the present invention and is accompanied by all non-gluing finished product embodiments. The air diversion radiator plate 13 installed in the interior space 110 of the fan hub 11 of the fan wheel 1 is equipped with a rotating shaft pivot seat 1332 at the central position of the interior space 110, and the rotating shaft pivot seat 1332 can be used for the rotating shaft 3 to insert and position. A plurality of airflow guide ribs 133 approaching the airflow guide ring 134 in a parabolic shape can be provided along the periphery of the rotating shaft pivot seat 1332. The airflow guide ribs 133 extend from the outside of the rotating shaft pivot seat 1332 in a parabolic path to the airflow guide ring inner peripheral surface 1341, and are connected at an approximate tangent to form at least one air duct 130 from narrow to wide and then to narrow. The narrow to wide space on one side of the air duct 130 close to the rotating shaft pivot seat 1332 forms an air inlet slot 131 that guides the air inside the interior space 110 to enter, and at the narrowest space in the space from wide to narrow on the other side of the air duct 130 forms an airflow turning curved surface 132 that guides the airflow to be squeezed downward and discharged outward. When the preset rotating shaft 3 drives the fan wheel 1 to rotate, the air inside the interior space 110 can be guided to enter along the bottom of the fan frame 2, and then enter the air inlet slot 131 of the air duct 130 along the air flow channel 220 between the axle seat 21 and the circuit board 22 and the airflow duct 40 between each stator silicon steel sheet set 41 and the axle seat 21. Then, the airflow is continuously squeezed toward the airflow guide ring inner peripheral surface 1341 of the airflow guide ring 134 until to the airflow turning curved surface 132, then turned downward through the airflow turning curved surface 132 and then discharged outward along the escape space 140 to form a positive pressure outside the interior space 110. A sleeve 211 is protruded from the axle seat 21 inside the accommodating space 20 of the fan frame 2 for the assembly of the preset rotating shaft 3. Then the axle seat disk 23 of the axle seat 21 is sealed (no opening), only leaving the gap between the fan hub 11 of the fan wheel 1 and the axle seat disk 23 or the circuit board 22 at the bottom of the fan frame 2, which is the fan hub interior space air outlet 142. This arrangement achieves the purpose of isolating the air from the external space from entering the interior space 110, that is, to prevent dirty air containing dust, salt, etc. from the external space from entering the interior space 110 and cause foreign matter such as dust, salt, etc. to accumulate in the air gap between the stator silicon steel sheet sets 41 and the rotor magnet 14 of the fan motor 4 or the gap between the bearing 31 and the rotating shaft 3 to further cause the fan to fail and stop running.

Furthermore, the above-mentioned axle seat 21 inside the fan frame 2 can be in different design patterns such as U shape or ⊓ shape. There is a sleeve 211 protruded inside the axle seat 21, and the sleeve 211 can be used for assembly of the preset rotating shaft 3. The bottom of the accommodating space 20 outside the axle seat 21 is opposite to the interior space 110 of the fan hub 11. A U-shaped axle seat 21 is provided in the accommodating space 20, and the U-shaped axle seat 21 is provided with a circuit board 22 on outside of the sleeve 211. The circuit board 22 is provided with a plurality of stator silicon steel sheet sets 41 for the preset motor 4 (including a plurality of inner silicon steel sheets 411, a plurality of outer silicon steel sheets 412 and enameled wire winding sets 413). Each stator silicon steel sheet set 41 and the circuit board 22 can be provided with air-isolating, dust-proof, and waterproof coating or glue filling operations to form a protective layer 42. With further use of this patent, even without coating and glue filling, the purpose of isolating the entry of air and water can be achieved. A plurality of air flow channels 220 can be provided at the periphery of the sleeve 211 near the axle seat 21 on the circuit board 22. The plurality of air flow channels 220 can be located at any appropriate positions on the circuit board 22, in particular, a plurality of air flow channels 220 can be provided on the circuit board 22 located below each stator silicon steel sheet set 41, and a plurality of air flow channels 220 can be provided at various appropriate positions on the circuit board 22 located below the preset motor 4. The plurality of air flow channels 220 can also be provided at appropriate locations on the circuit board 22 where electronic components are not provided, and the locations on the circuit board 22 where the plurality of air flow channels 220 are provided are not limited.

Also, please refer to FIG. 9. The above-mentioned fan frame 2 is provided with a I-shaped axle seat 21 in the accommodating space 20. The axle seat disk 23 of the axle seat 21 is sealed (no opening), only leaving the gap between the fan hub 11 of the fan wheel 1 and the axle seat disk 23 or the circuit board 22 at the bottom of the fan frame 2, which is the fan hub interior space air outlet 142. A circular circuit board 22 without a central hole is provided on the outside of the bottom of the I-shaped axle seat 21 to obtain a larger area for accommodating electronic components (a circular circuit board 22 with a central hole can also be provided to obtain a higher bearing 31 height. A plurality of air flow channels 220 can also be appropriately provided at various positions on the circuit board 22 where electronic components are not provided. The circuit board 22 is electrically connected to each stator silicon steel sheet set 41 of the preset motor 4 on the I-shaped axle seat 21. The outside of the bottom receiving space 210 of the axle seat 21 can be provided with a static impeller pressure plate 215 or an axle seat disk bracket 213, and the bottom of the receiving space 210 can be covered with an axle seat cover 216 to protect the circuit board 22.

When the above-mentioned fan of the present invention is actually operated, it is operated by the preset motor 4 in the interior space 110 of the fan hub 11 of the fan wheel 1 and the accommodating space 20 of the fan frame 2 for each stator silicon steel sheet set 41 to cooperate with the rotor magnet 14, driving the preset rotating shaft 3 to drive the fan hub 11 of the fan wheel 1 and the plurality of fan blades 12 to rotate. By the rotation of the fan wheel 1, the space of the air duct 130 is sucked in air by the air inlet slot 131, and the sucked in air is squeezed into the narrow space through the wide space, then turned downward through the airflow turning curved surface 132, and then discharged outward along the escape space 140 to form a positive pressure outside the interior space 110. Then the axle seat disk 23 of the axle seat 21 is sealed (no opening), only leaving the gap between the fan hub 11 of the fan wheel 1 and the axle seat disk 23 or the circuit board 22 at the bottom of the fan frame 2, which is the fan hub interior space air outlet 142. The rotation of the air diversion radiator plate 13 drives the air in the interior space 110 to be discharged outward and forms a positive pressure outside the interior space 110 to achieve the purpose of isolating the air from the external space from entering the interior space 110. Thus, it prevents the dirty air containing dust, salt, etc. from the external space from entering the interior space 110 to cause foreign matter such as dust, salt, etc. to accumulate in the air gap between the stator silicon steel sheet sets 41 of the fan motor 4 and the rotor magnet 14 or the gap between the bearing 31 and the rotating shaft 3 to further cause the fan to fail and stop running.

Another fan wheel heat dissipation structure can also achieve the same effect as above. As shown in FIG. 14, it is a side cross-sectional view of the sixth embodiment of the present invention (glue filling and no airflow duct 40), which comprises a fan wheel 1 and a fan frame 2.

The fan wheel 1 comprises a fan hub 11 and a plurality of fan blades 12 surrounding the outer surface thereof. The fan hub 11 is equipped with an interior space 110 inside, and the wall 111 of the interior space 110 is provided with a rotor magnet 14, and the center of the interior space 110 is provided with a rotating shaft bearing seat 112. The top surface of the interior space 110 is provided with an air diversion radiator plate 13 surrounding the outer part of the rotating shaft bearing seat 112. The space between at least one airflow guide rib 133 of the air diversion radiator plate 13 and the airflow guide ring 134 of the air diversion radiator plate 13 forms at least one air duct 130. An air inlet slot 131 is formed on one side of the air duct 130 to guide the external airflow to enter, and an airflow turning curved surface 132 is formed on the other side to guide the internal airflow to be squeezed and discharged outward.

The fan frame 2 has an accommodating space 20 inside for assembling the fan wheel 1. An axle seat disk 23 is provided in the center of the axle seat 21 inside the accommodating space 20. The periphery of the axle seat disk 23 is provided with a bracket or a static impeller pressure plate 215 or an axle seat disk bracket 213 and an air outlet 214. A sleeve 211 is protruded from the center of the axle seat disk 23, and a receiving space 210 for assembling the rotating shaft bearing seat 112 of the fan wheel 1 is provided inside the sleeve 211. A preset rotating shaft 3 for assembly of the preset rotating shaft bearing seat 112 is protruded inside the receiving space 210 of the sleeve 211 of the axle seat 21.

The top surface of the interior space 110 is provided with an air diversion radiator plate 13 surrounding the rotating shaft bearing seat 112. The air diversion radiator plate 13 is composed of at least one airflow guide rib 133 and an airflow guide ring 134. The wall 111 below the airflow guide ring 134 in the interior space 110 of the fan hub 11 is provided with the rotor magnet 14, and the airflow guide ring inner peripheral surface 1341 is connected to the rotor magnet inner peripheral surface 141 in flush to facilitate the smooth guidance of hot air flow through the escape space 140. The air duct 130 is formed by forming at least one space from wide to narrow between each airflow guide rib 133 of the air diversion radiator plate 13 and the airflow guide ring 134 of the air diversion radiator plate 13, that is, the airflow guide rib 133 extends from the outside of the rotating shaft pivot seat 1332 to the airflow guide ring inner peripheral surface 1341 in a parabolic path, and is connected at an approximate tangent to form the at least one air duct 130. The wide space on one side of the air duct 130 forms an air inlet slot 131 that guides the internal airflow to enter, and the narrow space on the other side of the air duct 130 forms the airflow turning curved surface 132 that guides the airflow to be squeezed downward and discharged outward. An escape space 140 is formed between the rotor magnet inner peripheral surface 141 of the rotor magnet 14 and the outer silicon steel sheets 412 for the extruded hot air to be discharged outward. A sleeve 211 for the assembly of the preset rotating shaft 3 is protruded from the axle seat 21 inside the accommodating space 20 of the fan frame 2. Then the axle seat disk 23 of the axle seat 21 is sealed (no opening), only leaving the gap between the fan hub 11 of the fan wheel 1 and the axle seat disk 23 or the circuit board 22 at the bottom of the fan frame 2, which is the fan hub interior space air outlet 142. The rotation of the air diversion radiator plate 13 drives the air in the interior space 110 to be discharged outward and forms a positive pressure outside the interior space 110 to achieve the purpose of isolating the air from the external space from entering the interior space 110. Thus, it prevents the dirty air containing dust, salt, etc. from the external space from entering the interior space 110 to cause foreign matter such as dust, salt, etc. to accumulate in the air gap between the stator silicon steel sheet sets 41 of the fan motor 4 and the rotor magnet 14 or the gap between the bearing 31 and the rotating shaft 3 to further cause the fan to fail and stop running.

The fan frame 2 has an internal accommodating space 20 for assembly of the fan wheel 1. A sleeve 211 is protruded from the axle seat 21 inside the accommodating space 20, and a preset rotating shaft 3 can be assembled at the center below the sleeve 211 of the axle seat 21, and a circuit board 22 can be installed on the axle seat 21 in the accommodating space 20. The circuit board 22 is provided with a plurality of stator silicon steel sheet sets 41 of the preset motor 4 (including a plurality of inner silicon steel sheets 411, a plurality of outer silicon steel sheets 412 and enameled wire winding sets 413. In order to further strengthen the purposes of rust prevention, dust-proof, waterproof, etc., each stator silicon steel sheet set 41 and the circuit board 22 can be provided with air-isolating, dust-proof, and waterproof coating or glue filling operations to form a protective layer 42 to isolate air and water from entering, thereby achieving the purposes of dustproof, waterproof, etc.). Each stator silicon steel sheet set 41 is in I shape arranged around the sleeve 211 of the axle seat 21. An airflow duct 40 is formed between the plurality of inner silicon steel sheets 411, the plurality of outer silicon steel sheets 412 and the enameled wire winding set 413 of each I-shaped stator silicon steel sheet set 41 (if the glue filling process is used, there will be no airflow duct 40). An escape space 140 is formed between each stator silicon steel sheet set 41 of the preset motor 4 and the adjacent rotor magnet 14.

The above-mentioned fan wheel 1 of the present invention forms at least one air duct 130 in the space between each airflow guide rib outer peripheral surface 1334 and airflow guide ring inner peripheral surface 1341 in the interior space 110 of the fan hub 11 for guiding airflow to enter. The wide space on one side of the air duct 130 forms the air inlet slot 131, and the air in the interior space 110 (if the coating method is used, the internal air includes the air between the plurality of inner silicon steel sheets 411, the plurality of outer silicon steel sheets 412, and the enameled wire winding sets 413 in the preset motor 4; if the glue filling method is used, the internal air will only be the air in the space in the interior space 110 that has not been filled with glue) is guided into the air inlet slot 131 and is squeezed toward the airflow turning curved surface 132 of the narrow space on the other side of the air duct 130 to flow, turn, and discharge outward through the escape space 140 between the rotor magnet 14 and the outer silicon steel sheets 412. This allows the interior space 110 to form a positive pressure at the gap between the fan hub 11 of the fan wheel 1 and the axle seat disk 23 or circuit board 22 at the bottom of the fan frame 2, that is, the fan hub interior space air outlet 142 (the only air outlet 214) relative to the external space. This positive pressure prevents dirty air containing dust, salt, etc. from the external space from entering the interior space 110 to cause foreign matter such as dust, salt, etc. to accumulate in the air gap between the stator silicon steel sheet sets 41 of the fan motor 4 and the rotor magnet 14 or the gap between the bearing 31 and the preset rotating shaft 3 to further cause the fan to stop running.

Please continue to refer to FIG. 5, FIG. 7, and FIG. 13, and assume that there is an air flow channel 220 in the middle of the circuit board 22 or between the circuit board 22 and the axle seat 21. A circuit board 22 is set on the outside of the sleeve 211 of the axle seat 21, and the bottom is covered with an axle seat cover 216, so that the circuit board 22 can be electrically connected to each stator silicon steel sheet set 41 of the preset motor 4. The area at the bottom of the axle seat 21 corresponding to the air outlet 214 of the fan blade 12 (that is, the corresponding area of the axle seat disk 23 and the fan hub 11 at the bottom of the axle seat 21) is sealed (no opening), only leaving the gap between the fan hub 11 of the fan wheel 1 and the axle seat disk 23 or the circuit board 22 at the bottom of the fan frame 2, that is, the fan hub interior space air outlet 142. The air diversion radiator plate 13 installed in the interior space 110 of the fan hub 11 of the fan wheel 1 is equipped with a rotating shaft pivot seat 1332 at the central position of the interior space 110, and the rotating shaft pivot seat 1332 can be used for the preset rotating shaft 3 to insert and position. The plurality of the airflow guide ribs 133 extend from the outside of the rotating shaft pivot seat 1332 in a parabolic path to the airflow guide ring inner peripheral surface 1341, and are connected at an approximate tangent to form at least one air duct 130 from narrow to wide and then to narrow. The space from narrow to wide on the side of the air duct 130 close to the rotating shaft pivot seat 1332 forms an air inlet slot 131 that guides the air in the interior space 110 to enter. At the narrowest space from the wide to narrow space on the other side of the air duct 130, an airflow turning curved surface 132 is formed that guides the airflow to be squeezed downward and discharged outward. When the preset rotating shaft 3 drives the fan wheel 1 to rotate, the air in the interior space 110 can be guided to enter along the bottom of the fan frame 2, and then along the air flow channel 220 between the axle seat 21 and the circuit board 22 and the airflow duct 40 between each stator silicon steel sheet set 41 and the axle seat 21 into the air inlet slot 131 of the air duct 130, and then the airflow is squeezed toward the airflow guide ring inner peripheral surface 1341 of the airflow guide ring 134 until to the airflow turning curved surface 132, then turned downward through the airflow turning curved surface 132 to flow along the escape space 140, and then the airflow is discharged outward through the fan hub interior space air outlet 142 to form a positive pressure outside the interior space 110, that is, the area within the bottom of the axle seat 21 corresponding to the air outlet 214 of the fan blades 12 (that is, the bottom of the axle seat 21, the corresponding surface of the fan hub 11) is sealed (no opening), only leaving the gap between the fan hub 11 of the fan wheel 1 and the bottom of the fan frame 2. Then, the rotation of the air diversion radiator plate 13 drives the air in the interior space 110 to be discharged outward and forms a positive pressure outside the interior space 110 to achieve the purpose of isolating the air from the external space from entering the interior space 110. Thus, it prevents dirty air containing dust, salt, etc. from the external space from entering the interior space 110 to cause foreign matter such as dust, salt, etc. to accumulate in the air gap between the stator silicon steel sheet sets 41 of the fan motor 4 and the rotor magnet 14 or the gap between the bearing 31 and the preset rotating shaft 3 to further cause the fan to stop running.

Please continue to look at FIG. 14, which is a side cross-sectional view of the sixth embodiment of the present invention, comprises a fan wheel 1 and a fan frame 2.

The fan wheel 1 comprises a fan hub 11 and a plurality of fan blades 12 surrounding the outer surface thereof. The fan hub 11 is equipped with an interior space 110 inside, and the wall 111 of the interior space 110 is provided with a rotor magnet 14, and the center of the interior space 110 is provided with a rotating shaft bearing seat 112. The top surface of the interior space 110 is provided with an air diversion radiator plate 13 surrounding the outside of the rotating shaft bearing seat 112. The space between at least one airflow guide rib 133 of the air diversion radiator plate 13 and the airflow guide ring 134 of the air diversion radiator plate 13 forms at least one air duct 130. An air inlet slot 131 is formed on one side of the air duct 130 to guide the internal airflow to enter, and an airflow turning curved surface 132 is formed on the other side to guide the internal airflow to be extruded outward.

The fan frame 2 is provided with an accommodating space 20 inside for assembling the fan wheel 1, that is, an axle seat disk 23 is provided at the center of the axle seat 21 inside the accommodating space 20. The periphery of the axle seat disk 23 is provided with a bracket or a static impeller pressure plate 215 or an axle seat disk bracket 213 and an air outlet 214. A sleeve 211 is protruded from the center of the axle seat disk 23. There is a receiving space 210 inside the sleeve 211 for assembling the rotating shaft bearing seat 112 of the fan wheel 1, that is, a preset rotating shaft 3 for the assembly of the rotating shaft bearing seat 112 is protruded inside the receiving space 210 of the sleeve 211 of the axle seat 21.

The top surface of the interior space 110 is provided with an air diversion radiator plate 13 surrounding the outside of the preset rotating shaft bearing seat 112. The air diversion radiator plate 13 is composed of at least one airflow guide rib 133 and an airflow guide ring 134. The wall 111 below the airflow guide ring 134 in the interior space 110 of the fan hub 11 is equipped with a rotor magnet 14, and the airflow guide ring inner peripheral surface 1341 is connected to the rotor magnet inner peripheral surface 141 in flush to facilitate the smooth flow of hot air through the escape space 140. At least one space from wide to narrow is formed between each airflow guide rib 133 of the air diversion radiator plate 13 and the airflow guide ring 134 of the air diversion radiator plate 13 to form an air duct 130, that is, the airflow guide rib 133 extends from the outside of the rotating shaft pivot seat 1332 to the airflow guide ring inner peripheral surface 1341 in a parabolic path, and is connected at an approximate tangent to form at least one air duct 130. The wide space on one side of the air duct 130 forms an air inlet slot 131 that guides the external airflow to enter. An airflow turning curved surface 132 is formed in the narrow space on the other side of the air duct 130 to guide the airflow to be squeezed downward and discharged outward. An escape space 140 is formed between the rotor magnet inner peripheral surface 141 and the outer silicon steel sheets 412 for the extruded hot air to be discharged outward, that is, the area within the air outlet 214 at the bottom of the axle seat 21 corresponding to the fan blades 12 (i.e., the bottom of the axle seat 21, the corresponding surface of the fan hub 11) is sealed (no opening), only leaving the gap between the fan hub 11 of the fan wheel 1 and the axle seat disk 23 or circuit board 22 at the bottom of fan frame 2, that is, the fan hub interior space air outlet 142. Then the rotation of the air diversion radiator plate 13 drives the air in the interior space 110 to be discharged outward from the fan hub interior space air outlet 142 and forms a positive pressure outside the interior space 110 to achieve the purpose of isolating the air from the external space from entering the interior space 110. Thus, it prevents dirty air containing dust, salt, etc. from the external space from entering the interior space 110 to cause foreign matter such as dust, salt, etc. to accumulate in the air gap between the stator silicon steel sheet sets 41 of the fan motor 4 and the rotor magnet 14 or the gap between the bearing 31 and the rotating shaft 3 to further cause the fan to stop running.

Furthermore, the above-mentioned axle seat 21 inside the fan frame 2 can be in different design patterns such as U shape or ⊓ shape. There is a sleeve 211 protruded inside the axle seat 21, and the sleeve 211 can be used for assembly of the preset rotating shaft 3. The bottom of the accommodating space 20 outside the axle seat 21 is opposite to the interior space 110 of the fan hub 11. A U-shaped axle seat 21 is provided in the accommodating space 20, and the U-shaped axle seat 21 is provided with a circuit board 22 on the outside of the sleeve 211. The circuit board 22 is provided with a plurality of stator silicon steel sheet sets 41 for the preset motor 4 (including a plurality of inner silicon steel sheets 411, a plurality of outer silicon steel sheets 412 and enameled wire winding sets 413). Each stator silicon steel sheet set 41 and the circuit board 22 can be provided with air-isolating, dust-proof, and waterproof coating or glue filling operations to form a protective layer 42 to isolate air and water from entering, and further enhance the effects of dustproof and waterproof. A plurality of air flow channels 220 can be provided at the periphery of the sleeve 211 near the axle seat 21 on the circuit board 22. The plurality of air flow channels 220 can be located at any appropriate positions on the circuit board 22, in particular, a plurality of air flow channels 220 can be provided on the circuit board 22 located below the stator silicon steel sheet sets 41. The plurality of air flow channels 220 can also be provided at appropriate locations on the circuit board 22 where electronic components are not provided, and the locations on the circuit board 22 where the plurality of air flow channels 220 are provided are not limited.

Also, as shown in FIG. 14, a plurality of air flow channels 220 can be appropriately provided at various positions on the circuit board 22 where electronic components are not provided, so that the circuit board 22 can be electrically connected to each stator silicon steel sheet set 41 of the preset motor 4 on the [ ]-shaped axle seat 21. A static impeller pressure plate 215 or an axle seat disk bracket 213 can be set outside the receiving space 210 at the bottom of the axle seat 21, and a bottom frame can be set below the receiving space 210 to protect the circuit board 22.

When the above-mentioned fan of the present invention is actually operated, the fan wheel 1 of the present invention forms at least one air duct 130 in the space of the interior space 110 of the fan hub 11 between each airflow guide rib outer peripheral surface 1334 and the airflow guide ring inner peripheral surface 1341 for guiding the airflow to enter. The wide space on one side of the air duct 130 forms an air inlet slot 131, which guides the air in the interior space 110 (if the coating method is used, the internal air includes the air between the plurality of inner silicon steel sheets 411, the plurality of outer silicon steel sheets 412, and the enameled wire winding sets 413 in the preset motor 4; if the glue filling method is used, the internal air will only be the air in the interior space 110 that has not been filled with glue) to enter the air inlet slot 131, so that the air entered the air inlet slot 131 can be squeezed toward the airflow turning curved surface 132 of the narrow space on the other side of the air duct 130 to further flow, turn, and be discharged outward through the escape space 140 between the rotor magnet 14 and the outer silicon steel sheets 412, and through the fan hub interior space air outlet 142 to form a positive pressure outside the interior space 110 to achieve the purpose of isolating the air from the external space from entering the interior space 110. This positive pressure prevents dirty air containing dust, salt, etc. from the external space from entering the interior space 110 to cause foreign matter such as dust, salt, etc. to accumulate in the air gap between the stator silicon steel sheet sets 41 of the fan motor 4 and the rotor magnet 14 or the gap between the bearing 31 and the rotating shaft 3 to further cause the fan to stop running.

The above are only preferred embodiments of the present invention and do not limit the patent scope of the present invention. Therefore, all simple modifications and equivalent structural changes made by using the description and drawings of the present invention shall be included in the patent scope of the present invention and shall be clearly stated.

In summary, the above-mentioned fan anti-foreign matter structure of the present invention can indeed achieve its effect and purpose when used. Therefore, the present invention is truly an invention with excellent practicability. In order to meet the application requirements for an invention patent, I filed the application in accordance with the law and hope that the Review Committee will approve the case as soon as possible to protect the inventor's hard work on research and development. If the J Review Committee has any doubts, please feel free to send us a letter for instructions. The inventor will do our best to cooperate. We sincerely appreciate it.

What the invention claimed is:

1. A fan anti-foreign matter structure, comprising a fan wheel and a fan frame, wherein:

said fan wheel comprises a fan hub, an interior space with an air outlet defined in said fan hub for the mounting of a rotating shaft, a plurality of fan blades surrounding an outer surface of said fan hub, an air diversion radiator plate mounted on a top surface of said internal space and surrounding the said rotating shaft mounted in said internal space, said air diversion radiator plate composing at least an airflow guide rib and an airflow guide ring, at least an air duct formed between at least one said airflow guide rib and said airflow guide ring, an air inlet slot formed on one side of said air duct to guide the air from said interior space to enter the respective said air duct, and an airflow turning curved surface formed on an opposite side of said air duct to squeeze and guide an airflow to enter the respective said air duct to discharge hot air outward and downward, so that a positive pressure is formed at the air outlet of said interior space relative to an external space to prevent dirty air containing dust, salt, etc. from the external space from entering said interior space of said fan hub;

said fan frame comprises an accommodating space, an axle seat, an axle seat disk, an axle seat bracket and a fan air outlet, said accommodating space accommodating said axle seat, said axle seat disk, said axle seat bracket and disposed in communication with said fan air outlet, said axle seat of said fan frame being used for assembling said fan wheel inside said accommodating space, a sleeve is protruded from said axle seat disk and used for assembly of said rotating shaft; and wherein said axle seat disk in said axle seat is sealed, and after said fan wheel is assembled into said accommodating space of said fan frame, only a gap between said fan hub and said axle seat disk of said fan frame or a gap between said fan hub and a circuit board on said axle seat disk (that is, the air outlet of the interior space inside the fan hub) is left, so that when a fan rotates, the air outlet of said interior space inside said fan hub forms a positive pressure relative to the external space to prevent dirty air containing dust, salt, etc. from the external space from entering said interior space of said fan hub to cause the fan to stop running.

2. The fan anti-foreign matter structure as claimed in claim 1, wherein said air diversion radiator plate comprises said airflow guide ring surrounding said rotating shaft and a plurality of said airflow guide ribs; a wall below said airflow guide ring in said interior space of said fan hub is provided with a rotor magnet; an inner peripheral surface of said airflow guide ring aligned with the inner peripheral surface of said rotor magnet and forms an escape space for the hot air to flow smoothly between an outer silicon steel sheet; each said airflow guide rib of said air diversion radiator plate is connected to said airflow guide ring so that at least one space from narrow to wide and then to narrow is formed; each said airflow guide rib extends from the outside of said rotating shaft pivot seat in a parabolic path to the inner peripheral surface of said airflow guide ring and is connected at an approximate tangent to form at least one said air duct, so that said air inlet slot that guides external airflow to enter is formed in the space from narrow to wide on one side of said air duct close to said rotating shaft pivot seat, and said airflow turning curved surface is formed at a narrowest space in the space from wide to narrow on the opposite side of said air duct to guide the airflow to be squeezed downward and discharge outward and to generate the positive pressure at the air outlet of the interior space of said fan hub relative to the external space.

3. A fan anti-foreign matter structure, comprising a fan wheel and a fan frame, wherein:

said fan wheel comprises a fan hub, an interior space, a plurality of fan blades surrounding an outer surface of said fan hub, a rotating shaft bearing seat set in said interior space, an air diversion radiator plate mounted on a top surface of said internal space and surrounding said rotating shaft bearing seat, said air diversion radiator plate comprising at least an airflow guide rib and an airflow guide ring, at least an air duct formed between said at least one said airflow guide rib and said airflow guide ring, an air inlet slot formed on one side of said air duct to guide an external airflow to enter said air duct, and an airflow turning curved surface formed on an opposite side of said air duct to guide the external airflow to be squeezed and discharged outward;

said fan frame comprises an accommodating space, an axle seat, an axle seat disk, an axle seat bracket and an air outlet, said accommodating space accommodating said axle seat, said axle seat disk, said axle seat bracket and disposed in communication with said air outlet, a sleeve set on said axle seat disk in said axle seat, a receiving space defined in said sleeve for assembly of said rotating shaft bearing seat of the fan wheel, a rotating shaft is protruded from said receiving space of said sleeve inside said axle seat for assembly of said rotating shaft bearing seat; and wherein said axle seat disk in said axle seat is sealed, and after said fan wheel is assembled into said accommodating space of said fan frame, only a gap between said fan hub and said axle seat disk of said fan frame or a gap between said fan hub and a circuit board on said axle seat disk (that is, the air outlet of the interior space inside said fan hub) is left, so that when a fan rotates, the air outlet of the interior space inside said fan hub forms a positive pressure relative to an external space to prevent dirty air containing dust, salt, etc. from the external space from entering said interior space of said fan hub to cause the fan to stop running.

4. The fan anti-foreign matter structure as claimed in claim 3, wherein said air diversion radiator plate comprises said airflow guide ring surrounding said rotating shaft bearing seat and a plurality of said airflow guide ribs; a wall below said airflow guide ring in said interior space of said fan hub is provided with a rotor magnet; an inner peripheral surface of said airflow guide ring aligned with the inner peripheral surface of said rotor magnet and forms an escape space between an outer silicon steel sheet for hot air to pass through; each said airflow guide rib is connected to said airflow guide ring so that at least one space from narrow to wide and then to narrow is formed; each said airflow guide rib extends from the outside of a rotating shaft pivot seat in a parabolic path to the inner peripheral surface of said airflow guide ring and is connected at an approximate tangent to form at least one said air duct, so that said air inlet slot that guides internal airflow to enter is formed in the space from narrow to wide on one side of said air duct, and said airflow turning curved surface is formed at a narrowest space in the space from wide to narrow on the opposite side of said air duct to guide an airflow to be squeezed downward and discharged outward and to generate the positive pressure at the air outlet of the interior space of said fan hub relative to an external space during rotation of the fan.

5. The fan anti-foreign matter structure as claimed in claim 4, wherein said escape space is formed between said rotor magnet and a plurality of outer silicon steel sheets, and a stator silicon steel sheet set and said circuit board are provided with a protective layer selectively formed by coating or glue filling to isolate air, dust and water.

* * * * *